US010903552B2

(12) United States Patent
Jeon

(10) Patent No.: US 10,903,552 B2
(45) Date of Patent: Jan. 26, 2021

(54) ELECTRONIC DEVICE INCLUDING ANTENNA DEVICE HAVING LOOP STRUCTURE

(71) Applicant: Samsung Electronics Co., Ltd., Suwon-si (KR)

(72) Inventor: Min-Hwan Jeon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/056,829

(22) Filed: Aug. 7, 2018

(65) Prior Publication Data

US 2019/0067808 A1 Feb. 28, 2019

(30) Foreign Application Priority Data

Aug. 31, 2017 (KR) ..... 10-2017-0110854

(51) Int. Cl.

| | |
|---|---|
| ***H01Q 1/27*** | (2006.01) |
| ***H01Q 7/00*** | (2006.01) |
| ***H01Q 5/321*** | (2015.01) |
| ***H01Q 9/42*** | (2006.01) |

(52) U.S. Cl.

CPC ..... *H01Q 1/273* (2013.01); *H01Q 5/321* (2015.01); *H01Q 7/00* (2013.01); *H01Q 9/42* (2013.01)

(58) Field of Classification Search

CPC ..... H01Q 1/273; H01Q 1/523; H01Q 1/38; H01Q 1/243; H01Q 7/00; H01Q 19/10; H01Q 19/18; H01Q 21/30; H01Q 5/30; H01Q 5/314; H01Q 5/321; H01Q 5/328; H01Q 9/42

See application file for complete search history.

(56) References Cited

U.S. PATENT DOCUMENTS

| | | | | |
|---|---|---|---|---|
| 2014/0327584 | A1* | 11/2014 | Chang | H01Q 1/243 343/702 |
| 2015/0048979 | A1 | 2/2015 | Asrani et al. | |
| 2016/0344439 | A1* | 11/2016 | Seol | H01Q 1/243 |
| 2017/0045916 | A1 | 2/2017 | Kim et al. | |
| 2017/0133752 | A1 | 5/2017 | Choi et al. | |

FOREIGN PATENT DOCUMENTS

KR 10-2017-0020139 A 2/2017

OTHER PUBLICATIONS

European Search Report dated Jan. 2, 2019, issued in European Patent Application No. 18191570.3.

* cited by examiner

*Primary Examiner* — Robert Karacsony
(74) *Attorney, Agent, or Firm* — Jefferson IP Law, LLP

(57) ABSTRACT

An electronic device is provided. The electronic device includes a housing including a first face, a second face that faces a direction opposite to the first face, and a side wall that encloses a portion of a space between the first face and the second face, a first radiation conductor extended along a circumferential direction of the housing as a portion of the side wall, and a plurality of second radiation conductors electrically connected to the first radiation conductor, and arranged inside of the first radiation conductor in a direction where the first radiation conductor extends. The plurality of second radiation conductors may form a plurality of closed loops with the first radiation conductor. The electronic device as above may vary according to the embodiments of the disclosure.

21 Claims, 16 Drawing Sheets

ELECTRONIC DEVICE INCLUDING ANTENNA DEVICE HAVING LOOP STRUCTURE

CROSS-REFERENCE TO RELATED APPLICATION(S)

This application is based on and claims priority under 35 U.S.C. § 119(a) of a Korean patent application number 10-2017-0110854, filed on Aug. 31, 2017, in the Korean Intellectual Property Office, the disclosure of which is incorporated by reference herein its entirety.

BACKGROUND

1. Field

The disclosure relates to an electronic device. More particularly, the disclosure relates to an electronic device including an antenna device having a loop structure for providing a wireless communication function.

2. Description of Related Art

Various types of communication protocols using electronic devices have been commercialized. Electronic devices such as a mobile communication terminal, which are carried and used by individuals, have become popular as various communication protocols are implemented in a single electronic device. For example, not only commercial communication network connection, but also wireless communication according to various communication protocols such as a short-range wireless network or a network for a position information service (e.g., a global navigation satellite system (GNSS) or a global positioning system (GPS)) may be performed through a single electronic device. In addition, various functions capable of improving user convenience, such as user authentication using near field communication (NFC), contactless credit card payment (e.g., magnetic secure transmission (MST)), and wireless charging are provided in the electronic devices.

In performing multiple different communication protocols in a single electronic device, an antenna device corresponding to each communication protocol, for example, a radiation conductor, may be mounted on the electronic device. For example, a single electronic device may be provided with a radiation conductor for commercial network connection, a radiation conductor for short-range wireless network connection, a radiation conductor for network connection for location information service, a radiation conductor for NFC, a radiation conductor for wireless charging, a radiation conductor for contactless credit card payment, etc.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an electronic device including an antenna device that is able to accommodate a plurality of communication protocols while being easily installed in a compact space.

By securing a sufficient space and interval in disposing a plurality of antenna devices in a single electronic device, it is possible to suppress electromagnetic interference with respect to other antenna devices or adjacent other electronic components. For example, it is possible to isolate each antenna device in order to provide a stable operating environment. However, in a compact space, it is difficult to secure antenna devices corresponding to a plurality of different communication protocols due to electromagnetic interference or the like, and even if such an isolation degree is secured with a sufficient space and interval, the efficiency of utilizing the internal space of the electronic device may deteriorate.

In an embodiment, in a miniaturized electronic device, such as a mobile communication terminal or a wearable electronic device, it may be difficult to secure space for installing other electronic components as well as the antenna device(s). In another embodiment, the environment in which an electronic device is used, for example, the environment in which an antenna device is disposed, affects the directivity, radiation efficiency, and the like of the antenna device. Thus, it may be difficult to secure sufficient operating performance of the antenna device.

Additional aspects will be set forth in part in the description which follows and, in part, will be apparent from the description, or may be learned by practice of the presented embodiments.

In accordance with an aspect of the disclosure, an electronic device is provided. The electronic device includes an antenna device that ensures good radiation efficiency even in an actual operating environment (e.g., in the state of being worn on a user's body).

In accordance with another aspect of the disclosure, an electronic device is provided. The electronic device includes a housing including a first face, a second face that faces a direction opposite to the first face, and a side wall that encloses a portion of a space between the first face and the second face, a first radiation conductor extended along a circumferential direction of the side wall, and a plurality of second radiation conductors electrically connected to the first radiation conductor, and arranged inside of the first radiation conductor in a direction where the first radiation conductor extends. The plurality of second radiation conductors may form a plurality of closed loops with the first radiation conductor.

In accordance with an aspect of the disclosure, an electronic device is provided. The electronic device includes an antenna, a circuit board including a first conductive pattern and a second conductive pattern which are electrically connected to the antenna to form a closed loop, and a communication circuit configured to transmit and receive a signal with an external electronic device using the antenna to which the first conductive pattern and the second conductive pattern are electrically connected.

In accordance with another aspect of the disclosure, a body-wearable device that is capable of being worn on a user's body is provided. The wearable device includes an antenna including a feed portion, a radiation portion, a first conductive pattern, and a second conductive pattern, wherein the first conductive pattern and the second conductive pattern form a closed loop with a portion of the radiation portion, and a communication circuit electrically connected to the feeding portion and configured to communicate a signal with an external electronic device using the antenna including the first conductive pattern and the second conductive pattern.

In an electronic device according to various embodiments disclosed herein, since a radiation conductor configured by a combination of a first radiation conductor and a second radiation conductor may form various current flow paths (having an electrical length corresponding to a resonant frequency wavelength), a resonant frequency can be formed in a plurality of frequency bands. For example, the first radiation conductor itself may form resonant frequencies in a commercial network frequency band (e.g., long-term evolution (LTE)) ranging from 1.85 to 2.7 GHz and a short-range wireless network frequency band (e.g., Bluetooth or wireless local area network (WLAN)) ranging from 2.4 to 2.485 GHz, and by combining the second radiation conductor, it is possible to form a resonant frequency in a frequency band for a position information service (e.g., global positioning system (GPS) communication) in a 1.575 GHz band. In an embodiment, by including a reflective member, the electronic device is able to control the radiation direction (e.g., orientation) and distribution of radiation power of a radiation conductor to provide good communication performance even in an actual use environment (e.g., in the state of being worn on a user's body).

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
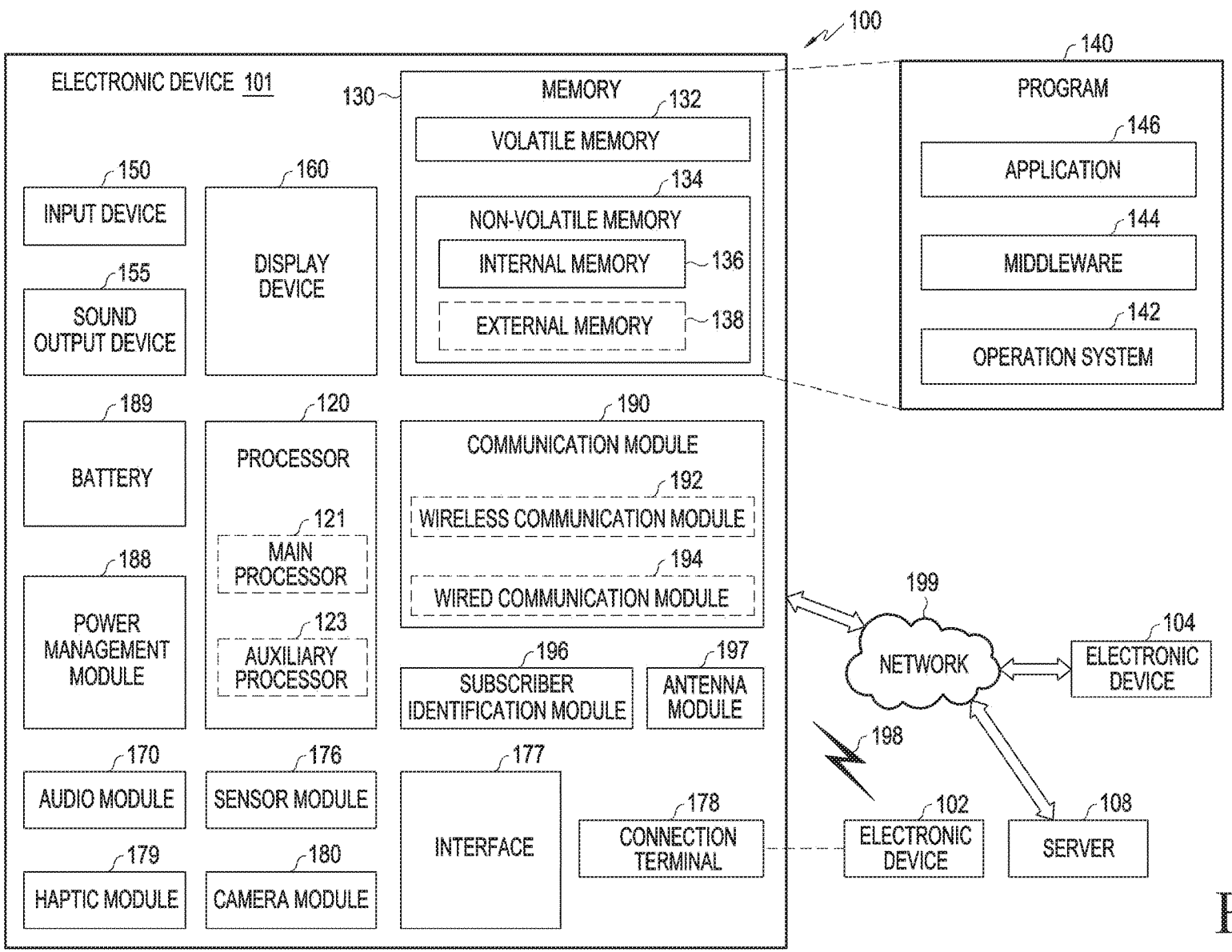
FIG. 1 is a block diagram illustrating an electronic device within a network environment according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the spirit and the scope of the disclosure. In addition, descriptions of well-known functions and constructions may be omitted for clarity and conciseness.

Although ordinal terms such as "first" and "second" may be used to describe various elements, these elements are not limited by the terms. The terms are used merely for the purpose to distinguish an element from the other elements. For example, a first element could be termed a second element, and similarly, a second element could be also termed a first element without departing from the scope of the disclosure. As used herein, the term "and/or" includes any and all combinations of one or more associated items.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Further, the relative terms "a front surface," "a rear surface," "a top surface," "a bottom surface," and the like which are described with respect to the orientation in the drawings may be replaced by ordinal numbers such as first and second. In the ordinal numbers such as first and second, their order are determined in the mentioned order or arbitrarily and may not be arbitrarily changed if necessary.

In the disclosure, the terms are used to describe specific embodiments, and are not intended to limit the disclosure. As used herein, the singular forms are intended to include the plural forms as well, unless the context clearly indicates otherwise. In the description, it should be understood that the terms "include" or "have" indicate existence of a feature, a number, a step, an operation, a structural element, parts, or a combination thereof, and do not previously exclude the existences or probability of addition of one or more another features, numeral, steps, operations, structural elements, parts, or combinations thereof.

Unless defined differently, all terms used herein, which include technical terminologies or scientific terminologies, have the same meaning as that understood by a person skilled in the art to which the disclosure belongs. Such terms as those defined in a generally used dictionary are to be interpreted to have the meanings equal to the contextual meanings in the relevant field of art, and are not to be interpreted to have ideal or excessively formal meanings unless clearly defined in the specification.

In the disclosure, an electronic device may be a random device, and the electronic device may be called a terminal, a portable terminal, a mobile terminal, a communication terminal, a portable communication terminal, a portable mobile terminal, a touch screen or the like.

For example, the electronic device may be a smartphone, a portable phone, a game player, a television (TV), a display unit, a heads-up display unit for a vehicle, a notebook computer, a laptop computer, a tablet personal computer (PC), a personal media player (PMP), a personal digital assistants (PDA), and the like. The electronic device may be implemented as a portable communication terminal which has a wireless communication function and a pocket size. Further, the electronic device may be a flexible device or a flexible display device.

The electronic device may communicate with an external electronic device, such as a server or the like, or perform an operation through an interworking with the external electronic device. For example, the electronic device may transmit an image photographed by a camera and/or position information detected by a sensor unit to the server through a network. The network may be a mobile or cellular communication network, a local area network (LAN), a wireless local area network (WLAN), a wide area network (WAN), an Internet, a small area network (SAN) or the like, but is not limited thereto.

FIG. 1 is a block diagram illustrating an electronic device in a network environment according to an embodiment of the disclosure.

Referring to FIG. 1, an electronic device 101 in a network environment 100 may communicate with an electronic device 102 via a first network 198 (e.g., short-range wireless communication), or may communicate with an electronic device 104 or a server 108 via a second network 199 (e.g., long-range wireless communication). According to an embodiment, the electronic device 101 may communicate with the electronic device 104 via the server 108. According to an embodiment, the electronic device 101 may include a processor 120, a memory 130, an input device 150, a sound output device 155, a display device 160, an audio module 170, a sensor module 176, an interface 177, a haptic module 179, a camera module 180, a power management module 188, a battery 189, a communication module 190, a subscriber identification module 196, and an antenna module 197. In some embodiments, at least one (e.g., the display device 160 or the camera module 180) of these components may be eliminated from the electronic device 101 or other components may be added to the electronic device 101. In some embodiments, some components may be implemented in an integrated form as in the case of, for example, the sensor module 176 (e.g., a fingerprint sensor, an iris sensor, or an illuminance sensor), which is embedded in, for example, the display device 160 (e.g., a display).

The processor 120 may control one or more other components (e.g., a hardware or software component) of the electronic device 101, which are connected to the processor 120, and may perform various data processing and arithmetic operations by driving, for example, software (e.g., a program 140). The processor 120 may load commands or data, which are received from other components (e.g., the sensor module 176 or the communication module 190), into a volatile memory 132 so as to process the commands or data, and may store resulting data into a non-volatile memory 134. According to an embodiment, the processor 120 may include a main processor 121 (e.g., a central processing unit or an application processor) and an auxiliary processor 123 operated independently from the main processor 121. The auxiliary processor 123 may additionally or alternatively use a lower power than the main processor 121, or may include an auxiliary processor 123 specialized for a designated function (e.g., a graphic processor device, an image signal processor, a sensor hub processor, or a communication processor). Here, the auxiliary processor 123 may be operated separately from the main processor 121 or in the manner of being embedded with the main processor 121.

In this case, the auxiliary processor 123 may control at least some functions or states associated with at least one of the components of the electronic device 101 (e.g., the display device 160, the sensor module 176, or the communication module 190), on behalf of the main processor 121, for example, while the main processor 121 is in an inactive (e.g., sleep) state, or together with the main processor 121 while the main processor 121 is in an active (e.g., application execution) state. According to an embodiment, the auxiliary processor 123 (e.g., an image signal processor or a communication processor) may be implemented as some of other functionally related components (e.g., camera module 180 or communication module 190). The memory 130 may store various data used by at least one component (e.g., the processor 120 or the sensor module 176) of electronic device 101, for example, software (e.g., the program 140) and input or output data, which is associated with commands associated the software. The memory 130 may include, for example, a volatile memory 132 or a non-volatile memory 134. The non-volatile memory 134 may include an internal memory 136. The non-volatile memory 134 may include an external memory 138, which is configured to receive an external memory device.

The program 140 may be software stored in the memory 130 and may include, for example, an operating system 142, middleware 144, or application 146.

The input device 150 is a device from the outside (e.g., user) for receiving commands or data to be used in a component (e.g., the processor 120) of the electronic device 101, and may include, for example, a microphone, a mouse, or a keyboard.

The sound output device 155 is a device for outputting a sound signal to the outside of the electronic device 101. The sound output device 155 may include, for example, a speaker for general use such as multimedia reproduction or sound reproduction and a receiver used only for telephone reception. According to an embodiment, the receiver may be formed integrally with or separately from the speaker.

The display device 160 visually provides information to a user of the electronic device 101 and may include, for example, a display, a hologram device, or a projector and a control circuit for controlling the corresponding device. According to an embodiment, the display device 160 may include a touch circuit or a pressure sensor capable of measuring the intensity of the pressure of the touch.

The audio module 170 may bidirectionally convert sound and electrical signals. According to an embodiment, the audio module 170 may acquire sound through the input device 150 or may output sound through the sound output device 155 or an external electronic device (e.g., the electronic device 102 (e.g., a speaker or headphone)) connected with the electronic device 101 in a wireless or wired manner.

The sensor module 176 may generate an electrical signal or a data value corresponding to an internal operating state (e.g., power or temperature) of the electronic device 101 or an external environmental condition. The sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support a designated protocol that may be connected to an external electronic device (e.g., the electronic device 102) in a wired or wireless manner. According to an embodiment, the interface 177 may include a High definition multimedia interface (HDMI), a universal serial bus (USB) interface, a secure digital (SD) card interface, or an audio interface.

The connection terminal 178 may be a connector capable of physically interconnecting the electronic device 101 and an external electronic device (e.g., the electronic device 102), such as an HDMI connector, a USB connector, an SD card connector, or an audio connector (e.g., a headphone connector).

The haptic module 179 may convert an electrical signal into a mechanical stimulus (e.g., vibration or motion) or an electrical stimulus that the user can perceive through a tactile or kinesthetic sense. The haptic module 179 may include, for example, a motor, a piezoelectric element, or an electrical stimulation device.

The camera module 180 is capable of capturing, for example, a still image and a video image. According to an embodiment, the camera module 180 may include one or more lenses, an image sensor, an image signal processor, or a flash.

The power management module 188 is for managing power supplied to the electronic device 101, and may be configured as at least a part of, for example, a power management integrated circuit (PMIC).

The battery 189 is for supplying power to at least one component of the electronic device 101 and may include, for example, a non-rechargeable primary battery, a rechargeable secondary battery, or a fuel cell.

The communication module 190 may establish a wired or wireless communication channel between the electronic device 101 and an external electronic device (e.g., the electronic device 102, the electronic device 104, or the server 108) and may support communication via the established communication channel. The communication module 190 may include a processor 120 (e.g., an application processor) and one or more communication processors, which are independently operated and support wired communication or wireless communication. According to an embodiment, the communication module 190 may include a wireless communication module 192 (e.g., a cellular communication module, a short range wireless communication module, or a global navigation satellite system (GNSS) communication module) or a wired communication module 194 (e.g., LAN communication module or a power line communication module), and may perform communication with an external electronic device via a first network 198 (e.g., a short-range communication network, such as Bluetooth, Wi-Fi direct, or infrared data association (IrDA)) or a second network 199 (e.g., a long-range communication network, such as a cellular network, the Internet, or a computer network (e.g., LAN or WAN)), using a corresponding communication module among the above-mentioned communication modules. Various types of communication modules 190 described above may be implemented as a single chip in which at least some of the communication modules are integrated, or may be implemented as separate chips.

According to an embodiment, the wireless communication module 192 may identify and authenticate the electronic device 101 within the communication network using the user information stored in the subscriber identification module 196.

The antenna module 197 may include one or more antennas configured to transmit/receive signals or power to/from the outside. According to an embodiment, the communication module 190 (e.g., the wireless communication module 192) may transmit/receive signals to/from an external electronic device via an antenna suitable for the communication protocol thereof.

Figure 2:
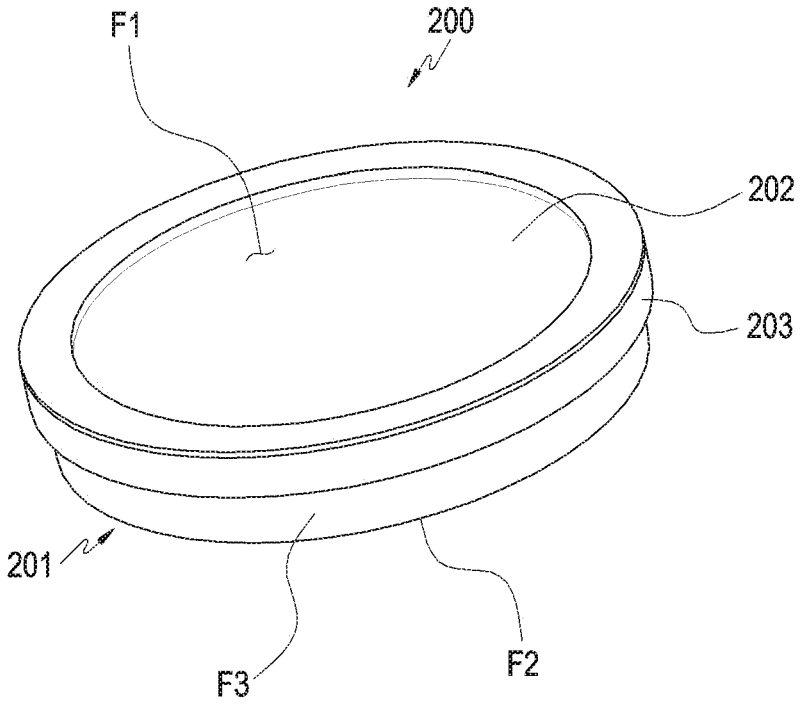
FIG. 2 is a perspective view illustrating an electronic device according to an embodiment of the disclosure.

FIG. 2 is a perspective view illustrating an electronic device according to an embodiment of the disclosure.

Figure 3:
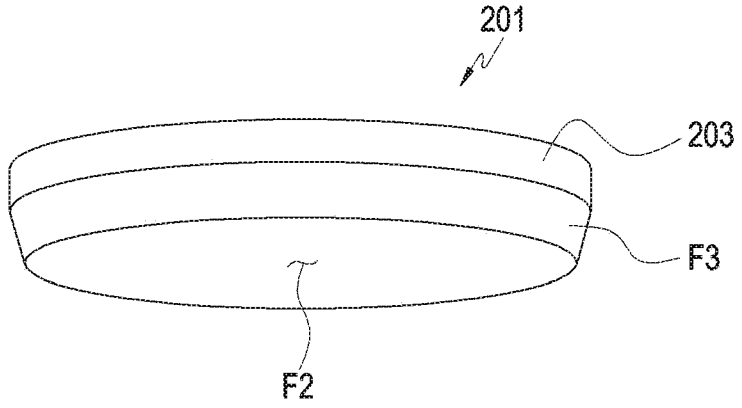
FIG. 3 is a perspective view illustrating the electronic device of FIG. 2 viewed from another direction according to an embodiment of the disclosure.

FIG. 3 is a perspective view illustrating the electronic device of FIG. 2 viewed in another direction according to an embodiment of the disclosure.

Referring to FIGS. 2 and 3, an electronic device 200 (e.g., the electronic device 101 of FIG. 1) may include a housing 201 and a radiation conductor 203 (the antenna module 197 of FIG. 1) disposed inside or outside the housing 201 or disposed as a portion of the housing 201. A processor or a communication module (e.g., the processor 120 or the communication module 190 of FIG. 1) of the electronic device 200 may perform wireless communication through at least a portion of the radiation conductor 203. For example, the radiation conductor 203 forms, for example, at least a portion of a radiation portion of the electronic device 200, and may transmit/receive wireless signals by receiving feed signals provided from the processor or the communication module. In an embodiment, the electronic device 200 may be a wearable electronic device, and for example, when the electronic device 200 includes a wearing member or the like, the user may wear the electronic device 200 on the wrist, or the like. However, the disclosure is not needed to be limited thereto.

According to various embodiments of the disclosure, the housing 201 may include a first face F1 (e.g., a front face), a second face F2 (e.g., a rear face) facing a direction opposite to the first face F1, and a side wall F3 provided between the first face F1 and the second face F2. The housing 201 may accommodate therein a circuit board (e.g., the circuit board 204 of FIG. 4) mounted with a processor or the like therein, a battery (e.g., the battery 189 of FIG. 1), various input/output devices, etc. In an embodiment, the side wall F3 may be formed to connect the first face F1 and the second face F2 while enclosing at least a portion of the space between the first face F1 and the second face F2. In another embodiment, a display device 202 (e.g., the display device 160 of FIG. 1) may be disposed on the first face F1 so as to provide visual information to the user. In a specific embodiment of the disclosure, the housing 201 has generally a coin shape or a disc shape, but the disclosure needs not be limited thereto. For example, the housing 201 may have a plate shape, a cube shape, or a curved shape, and in some embodiments, the housing 201 may include a rollable or bendable structure.

According to various embodiments of the disclosure, the radiation conductor 203 may have a shape generally corresponding to the shape of the side wall F3, and may form a portion of the side wall F3. In some embodiments, when the radiation conductor 203 is made of a metallic material and the side wall F3 is made of a synthetic resin material, the radiation conductor 203 may be disposed inside the side wall F3 through a dual injection molding process or the like. In some embodiments, the sidewall F3 may be made of a metallic material, and the portion forming the radiation conductor 203 in the side wall F3 may be insulated from other portions of the sidewall F3. The structure of the radiation conductor 203 will be described in more detail with reference to FIG. 4.

Figure 4:
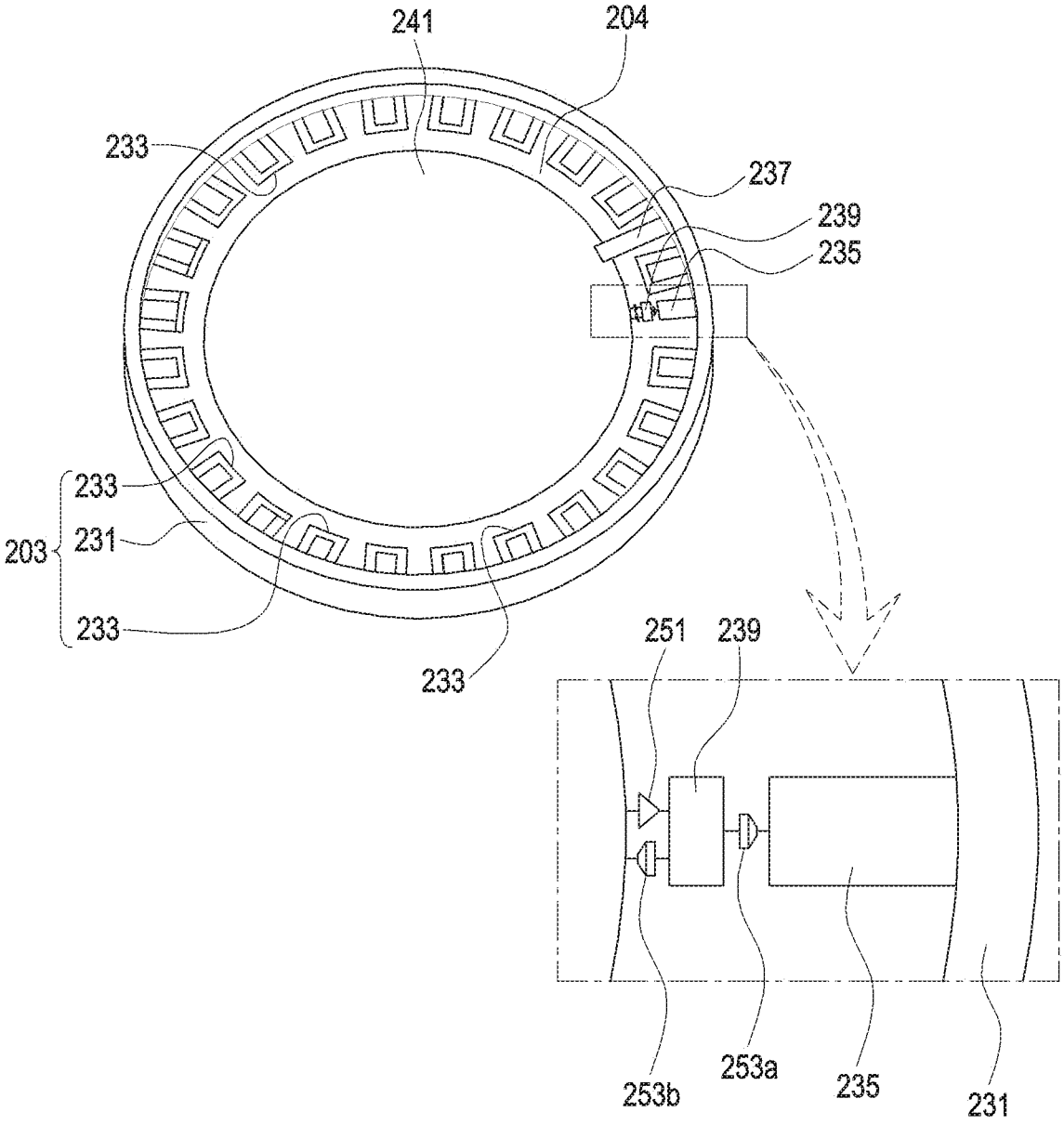
FIG. 4 is a perspective view illustrating a structure of an antenna device of an electronic device according to an embodiment of the disclosure.

FIG. 4 is a perspective view illustrating a structure of an antenna device of the electronic device according to an embodiment of the disclosure.

Referring to FIG. 4 again, the electronic device 200 may include an antenna device (e.g., the radiation conductor 203). In some embodiments, the radiation conductor 203 may form at least a portion of the antenna module 197 of FIG. 1 and may be connected to a communication circuit, for example, the processor 120 or the communication module 190 (e.g., the wireless communication module 192) of FIG. 1 so as to transmit or receive a wireless signal.

According to various embodiments of the disclosure, the radiation conductor 203 may include a first radiation conductor 231 provided as a portion of the side wall F3 (or buried in the side wall F3), and a plurality of second radiation conductors 233 disposed inside the first radiation conductor 231. The first radiation conductor 231 may have a closed loop shape extending in the circumferential direction of the housing 201. In some embodiments, the first radiation conductor 231 may have a structure that is divided into a plurality of portions while being disposed along a generally closed-loop trace. For example, a plurality of conductors arranged along the circumferential direction of the housing 201 may be combined to form the first radiation conductor 231. When the first radiation conductor 231 is formed of a combination of a plurality of conductors, the number, arrangement, etc. of the conductors may be appropriately designed according to the specifications required in the electronic device 200 and the like. However, in a specific embodiment of the disclosure, an example in which the first radiation conductor 231 has a closed loop shape will be described.

According to various embodiments of the disclosure, the second radiation conductors 233 are arranged along the direction in which the first radiation conductors 231 extend, and each of the second radiation conductors 233 is combined with a portion of the first radiation conductor 231 so as to form a closed loop. In a specific embodiment of the disclosure, it is exemplified that each of the second radiation conductors 233 combined with a portion of the first radiation conductor 231 forms a generally rectangular closed loop, but may form a closed loop having a circular shape, an elliptical shape, or a polygonal shape. The second radiation conductors 233 may be arranged, for example, at regular intervals along the direction in which the first radiation conductor 231 extend while extending from the inside of the first radiation conductor 231.

In an embodiment of the disclosure, the second radiation conductors 233 are formed integrally with the first radiation conductor 231 and extend from the first radiation conductor 231 toward the inside of the housing 201. For example, in a specific embodiment of the disclosure, the second radiation conductors 233 are described separately from the first radiation conductor 231, but in practice, each of the second radiation conductors 233 may be formed as at least a portion of the first radiation conductor 231. In some embodiments, the second radiation conductors 233 extend from the first radiation conductor 231 toward the inside of the housing 201, but do not protrude into the inner space of the housing 201. For example, the second radiation conductors 233 may be disposed in the sidewall F3. In another embodiment, the second radiation conductors 233 may be conductive patterns formed on the circuit board 204 accommodated in the housing 201, and may be arranged along the edge of the circuit board 204. For example, when the circuit board 204 is assembled to the housing 201, the conductive patterns, for example, each of the second radiation conductors 233 may be electrically connected to the first radiation conductor 231 so as to form a closed loop.

According to various embodiments of the disclosure, the conductive patterns forming the second radiation conductors 233 includes a first conductive pattern formed on one face of the circuit board 204 and a second conductive pattern formed on the other face of the circuit board 204. For example, conductive patterns may be respectively formed on both faces of the circuit board 204 so as to form the second radiation conductors 233. In an embodiment, using the antennas (e.g., the radiation conductors 203) electrically connected to the conductive patterns, the communication circuit of the electronic device 200, for example, the processor 120 or the communication module 190 (e.g., the wireless communication module 192) of FIG. 1 may transmit/receive a wireless signal to/from an external electronic device.

According to various embodiments of the disclosure, the radiation conductors 203 may provide flow paths for signal power (e.g., signal power of the transmitted/received wireless signals). For example, in a certain frequency band, the radiation conductors 203 may form a resonance frequency using a path corresponding to the shape of the first radiation conductor 231, and in another frequency band, a resonant frequency may be formed using a path including the first radiation conductor 231 and the second radiation conductors 233. When the first radiation conductor 231 is formed of a plurality of conductors, the resonant frequency may be formed in another frequency band.

In an embodiment of the disclosure, as viewed from the first face F1 side of the electronic device 200, the first radiation conductor 231 may form a circular closed loop having an outer diameter of 55 mm and an inner diameter of 52 mm. For example, the first radiation conductor 231 may form a closed loop using a metallic material having a thickness of about 1.5 mm or a printed circuit pattern having a width of about 1.5 mm. In some embodiments, each of the second radiation conductors 233 may be formed by bending a metallic material having a thickness of 1 mm or by a printed circuit pattern having a width of 1 mm. According to an embodiment, the second radiation conductors 233 may form a rectangular closed loop of 4 mm*3.8 mm together with a portion of the first radiation conductor 231. In a specific embodiment of the disclosure, some numerical values relating to the thickness (or width), size, etc. of the first and second radiation conductors 231 and 233 are presented, but the disclosure is not limited thereto. For example, the thicknesses, sizes, etc. of the first and second radiation conductors 231 and 233 may be designed in consideration of the size of the electronic device 200, performances required for the electronic device, a used frequency band, a practical use environment, etc.

According to various embodiments of the disclosure, the electronic device 200 may include a ground conductor 241 that provides a reference potential for the radiation conductors 203. The ground conductor 241 may be included in the circuit board 204, for example. According to an embodiment, the electronic device 200 may further include a feed portion extending from the first radiation conductor 231 (or the second radiation conductor 233), for example, a feed port 235, or a shorting pin 237 extending from the first radiation conductor 231 (or the second radiation conductor 233) and connected to the ground conductor 241. The feed port 235 may be connected to the feed point 251 so as to supply and deliver a feed signal to the radiation conductor 203. In an embodiment, the feed point 251 may be disposed between the ground conductor 241 and the feed port 235.

In some embodiments of the disclosure, the electronic device 200 may further include a dummy conductor 239 and lumped elements 253*a* and 253*b* to form an impedance matching circuit for the antenna device, for example, the radiation conductor 203. The dummy conductor 239 may be disposed (or formed) on the circuit board 204 between the ground conductor 241 and the feed port 235. In this case, the feed point 251 may be disposed between the dummy conductor 239 and the ground conductor 241. The dummy conductor 239 may be connected to the feed port 235 via at least one of the lumped elements 253*a* and 253*b*, for example, the first lumped element 253*a*. According to an embodiment, at least one of the lumped elements 253*a* and 253*b*, for example, the second lumped element 253*b*, may connect the dummy conductor 239 to the ground conductor 241. For example, the second lumped element 253*b* may be connected to the feed point 251 in parallel between the dummy conductor 239 and the ground conductor 241. The dummy conductors 239 or the lumped elements 253*a* and 253*b* are used to correct resonant frequency characteristics depending on the shapes, thicknesses, materials, etc., of the radiation conductor 203 and ground conductor 241. For example, in consideration of the performance required for the electronic device 200, the use environment of the electronic device 200, and the design conditions of the radiation conductors 203 and the ground conductor 241, an impedance matching circuit as described above may be appropriately disposed.

Figure 5:
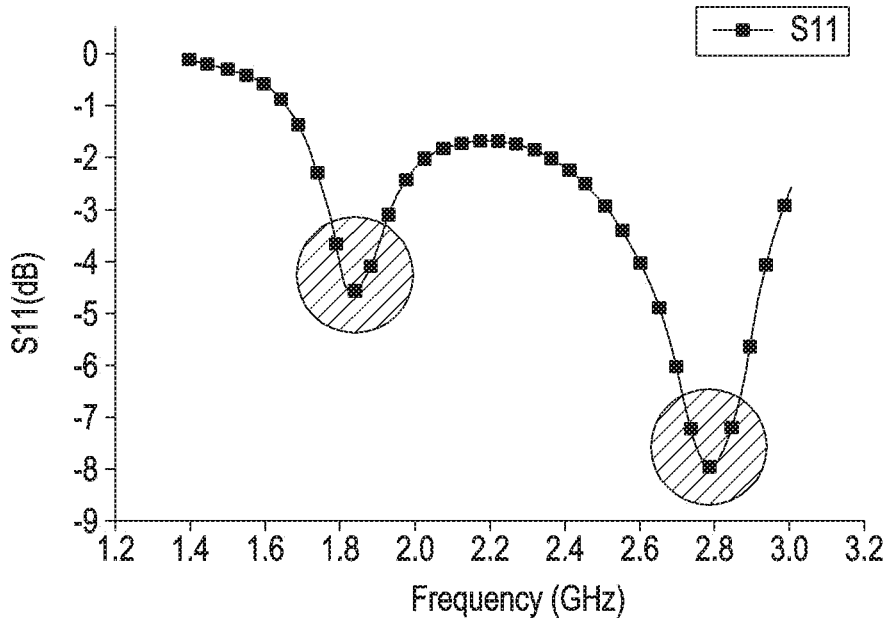
FIG. 5 is a graph showing a reflection coefficient measured for an electronic device without a second radiation conductor according to an embodiment of the disclosure.

FIG. 5 is a graph showing a reflection coefficient measured for an electronic device without a second radiation conductor according to an embodiment of the disclosure.

Figure 6:
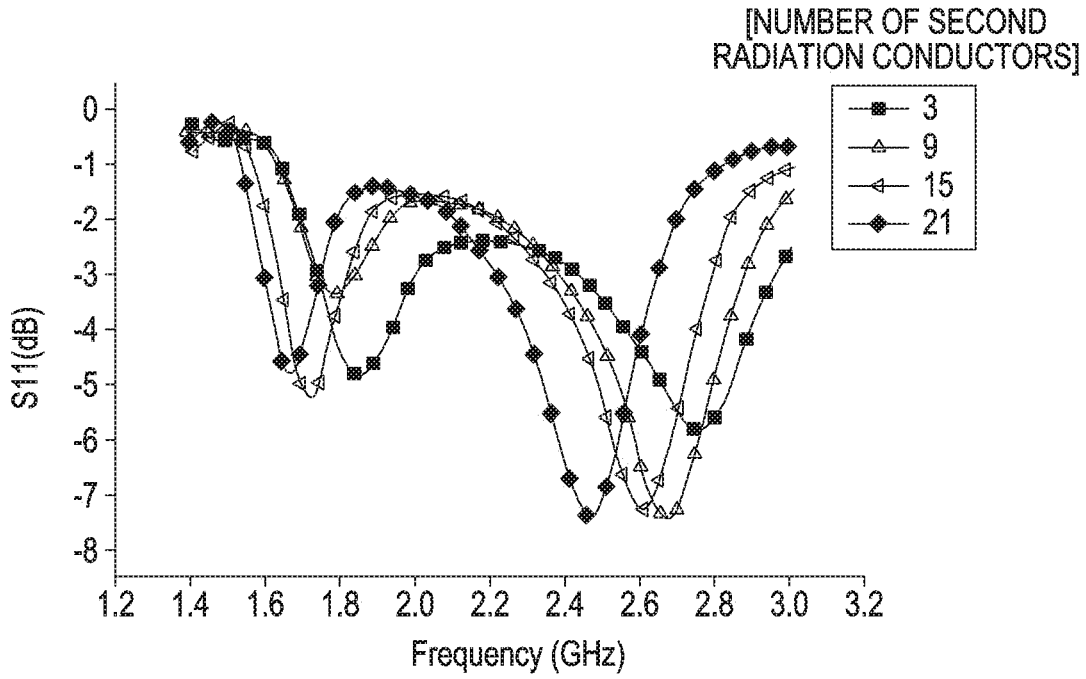
FIG. 6 is a graph showing a reflection coefficient measured for an electronic device with a second radiation conductor according to an embodiment of the disclosure.

FIG. 6 is a graph showing a reflection coefficient measured for an electronic device with a second radiation conductor according to an embodiment of the disclosure.

Referring to FIG. 6, the graph shows a change in reflection coefficient, for example, an S11-parameter, depending on the number of the second radiation conductors 233, for example. The graph shows results obtained by measuring the reflection coefficient S11 in the structures in which the radiation conductors 203 include 3, 9, 15, and 21 second radiation conductors 233.

Referring to FIG. 5, the resonant frequency is formed in approximately 1.8 GHz and 2.8 GHz bands according to the measurement results of the reflection coefficient S11 before the second radiation conductors 233 are disposed. Referring to FIG. 6, the resonant frequency gradually decreases as the number of the second radiation conductors 233 increases. For example, a resonant frequency is formed in approximately 1.6 GHz and 2.45 GHz bands when 21 second radiation conductors 233 are disposed.

Typically, it may be difficult to secure a resonant frequency in a low frequency band, for example, a global positioning system (GPS) communication frequency band of 1.575 GHz through an antenna device disposed in a compact space. According to various embodiments, by disposing a plurality of second radiation conductors 233 inside the first radiation conductor 231, the resonant frequency may be ensured even in a low frequency band such as the GPS communication frequency band.

Figure 7:
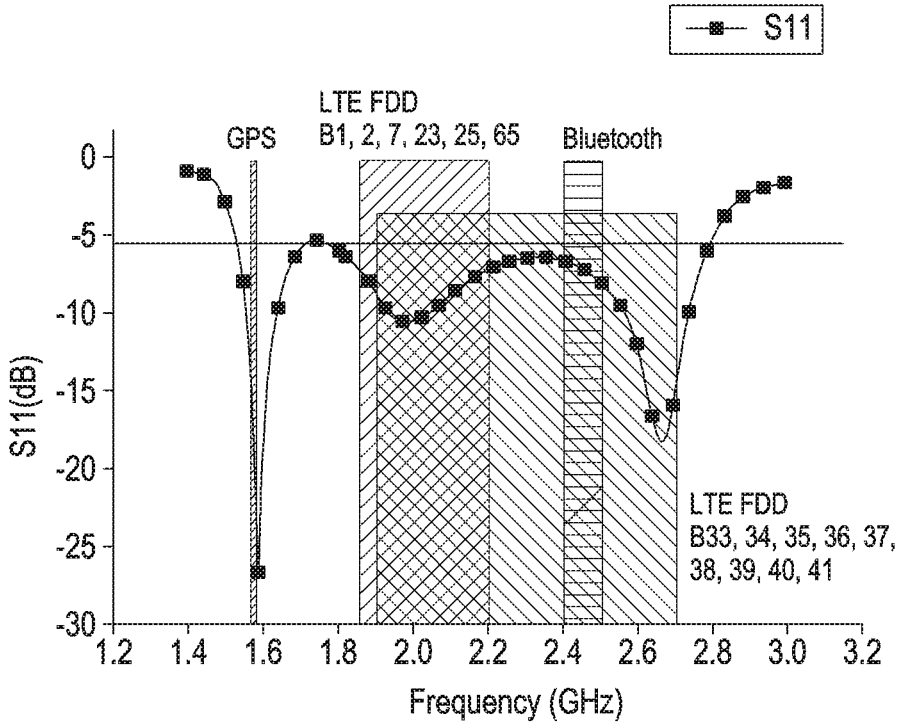
FIG. 7 is a graph showing a reflection coefficient measured according to optimization of an antenna device in an electronic device according to an embodiment of the disclosure.

FIG. 7 is a graph showing a reflection coefficient measured according to optimization of an antenna device in an electronic device according to an embodiment of the disclosure.

Referring to FIG. 7, the optimization of the antenna device may be achieved, for example, through an impedance matching circuit by a combination of a dummy conductor 239 and lumped elements 253*a* and 253*b* of FIG. 4. With the optimization described above, the antenna device, for example, the radiation conductors 203, may form a resonant frequency in a 2.0 GHz band in addition to the 1.6 GHz and 2.45 GHz bands.

According to various embodiments, the number of second radiation conductors 233 and the configuration of the dummy conductor 239 or the lumped elements 253*a* and 253*b* for forming an impedance matching circuit may be variously provided in consideration of a practical operation environment of the electronic device. For example, by combining the number of the second radiation conductors 233 and the configuration of the dummy conductor 239 and the configurations of the lumped elements 253*a* and 253*b* for forming an impedance matching circuit, even with a miniaturized electronic device, it is possible to ensure respective resonant frequencies in a GPS communication frequency band of about 1.575 GHz, a long-term evolution (LTE) communication frequency band ranging from 1.85 to 2.7 GHz, and a Bluetooth (or Wi-Fi) communication frequency band ranging from 2.4 to 2.485 GHz. Here, the miniaturized electronic device may include a first radiation conductor (e.g., the first radiation conductor 231 of FIG. 4) provided as a portion of a side wall (e.g., the side wall F3 of FIG. 2) having an outer diameter of about 55 mm, as described above. However, the electronic device may include a housing (e.g., the housing 201 of FIG. 2) having various shapes and sizes, but the disclosure is not limited by the sizes or the like mentioned in the specific embodiments described above.

Figure 8:
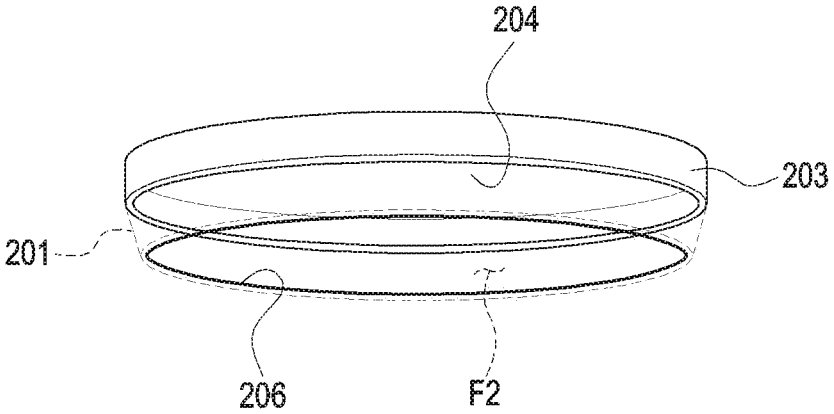
FIG. 8 is a perspective view illustrating a portion of an electronic device according to an embodiment of the disclosure.

FIG. 8 is a perspective view illustrating a portion of an electronic device according to an embodiment of the disclosure.

Figure 9:
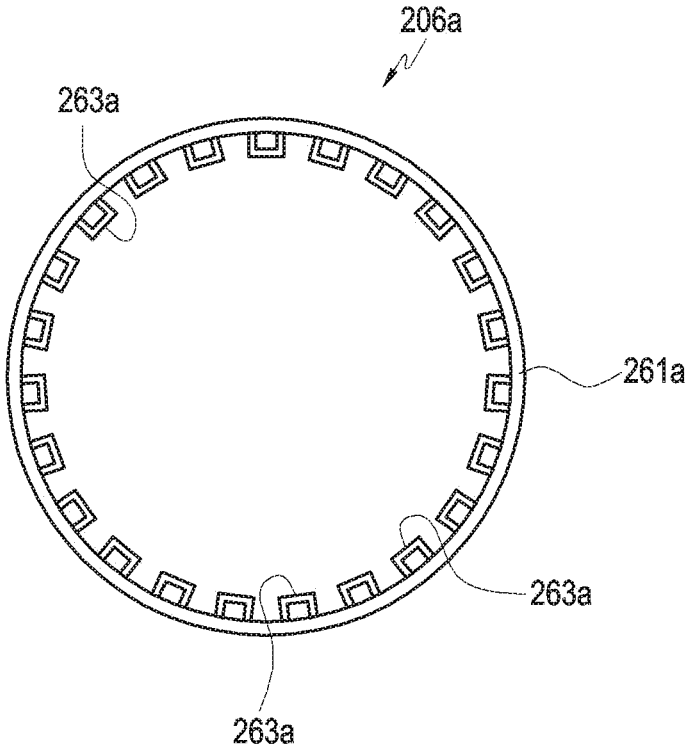
FIGS. 9 and 10 are perspective views illustrating modifications of a reflective member of an electronic device according to various embodiments of the disclosure.
Figure 10:
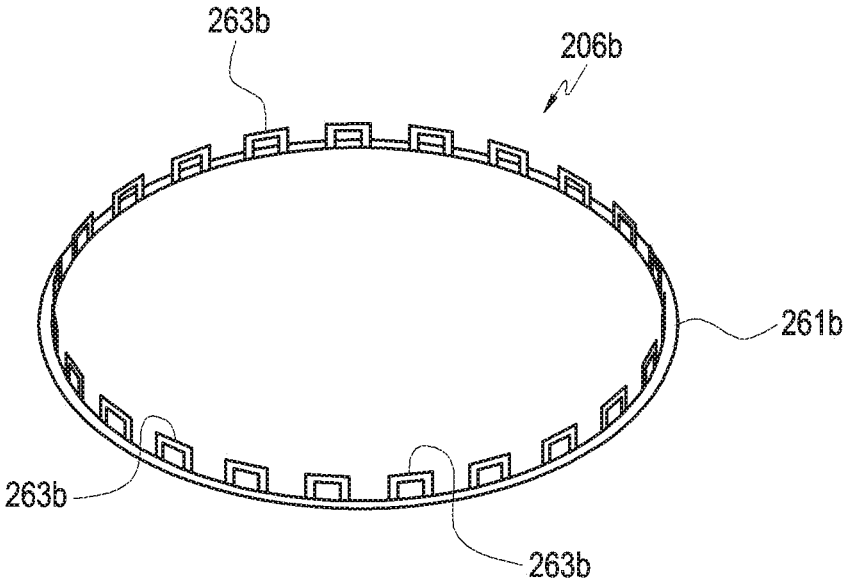

FIGS. 9 and 10 are perspective views illustrating modifications of a reflective member of an electronic device according to various embodiments of the disclosure.

Referring to FIG. 8, an electronic device (e.g., the electronic device 200) may include a reflective member 206. The reflective member 206 may control of the orientation of the antenna device, e.g. the radiation conductors (e.g., the radiation conductors 203 of FIG. 4) in the practical use environment (e.g., in the state of being worn on the user's body) of the electronic device 200. According to various embodiments, the reflective member 206 may be embedded in the housing 201 between the radiation conductors 203 and the second face F2 of the housing 201. For example, when the radiation conductors 203 transmit/receive a wireless signal, the reflective member 206 may reflect the received/transmitted wireless signal to a direction where the first face (e.g., the first face F1 in FIG. 2) of the housing 201 is directed. According to an embodiment, the reflective member 206 may be disposed in one direction (e.g., below) with respect to the circuit board, and may improve the transmission/reception performance of a wireless signal through the radiation conductors 203, which is implemented in the direction opposite to the one direction (e.g., the upper side of the circuit board).

According to various embodiments, the reflective member 206 may have a shape generally corresponding to the radiation conductors 203 (e.g., the first radiation conductor 231). For example, the reflective member 206 may have a shape that forms a closed loop or a shape in which a plurality of conductors are arranged along a trace forming a closed loop. Referring to FIGS. 9 and 10 again, the reflective members 206*a* and 206*b* (e.g., the reflective member 206 in FIG. 8) may include first reflective members 261*a* and 261*b* in the form of a closed loop, and a plurality of different conductive patterns disposed on the first reflective members 261*a* and 261*b*, for example, at least one second reflective member 263*a* or 263*b*. The second reflective members 263*a* and 263*b* may be formed integrally with the first reflective members 261*a* and 261*b* and may be combined with some of the first reflective members 261*a* and 261*b* to form a closed loop. For example, in a specific embodiment of the disclosure, the second reflective members 263*a* and 263*b* are described separately from the first reflective members 261*a* and 261*b*, but in practice, a second reflective member 263*a* or 263*b* may be formed as a portion of a first reflective member 261*a* or 261*b*.

According to various embodiments of the disclosure, the second reflective members may be formed in a shape protruding to the inside of the first reflective members 261*a* and 261*b* (e.g., the second reflective member 263*a*), or in a shape protruding from one face of the first reflective members 261*a* and 261*b* toward the first face F1 (or, toward the second face F2) (e.g., the second reflective member 263*b*). The outer diameter and inner diameter of the first reflective members 261*a* and 261*b*, the number and arrangement of the second reflective members 263*a* and 263*b*, the closed loop shape formed by the second reflective members 263*a* and 263*b*, etc. may be variously designed in consideration of the actual use environment of the electronic device 200.

In an embodiment of the disclosure, in the state in which the second face F2 faces the user's body, or in the state in which the second face F2 is in contact with the user's body, the user may wear the electronic device 200. The reflective member 206 is positioned between the radiation conductors 203 and the second face F2, and thus, the reflective member 206 may be practically located between the radiation conductor 203 and the user's body. Thus, in the state in which the user wears the electronic device 200, the reflective member 206 may cause the radiation power of the radiation conductors 203 to be concentrated to the external space, for example, in the direction in which the first face F1 is directed, so that the efficiency of the antenna device can be improved. In some embodiments, when the housing 201 has a structure worn in the state in which the first face F1 thereof faces the user's body, the reflective member 206 may be located between the radiation conductors 203 and the first face F1.

Figure 11:
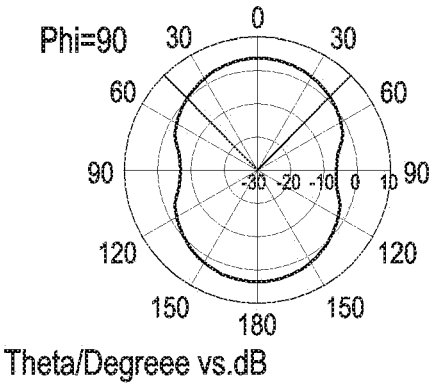
FIGS. 11 and 12 are graphs illustrating measured radiation characteristics of an antenna device without reflective members of an electronic device according to various embodiments of the disclosure.
Figure 12:
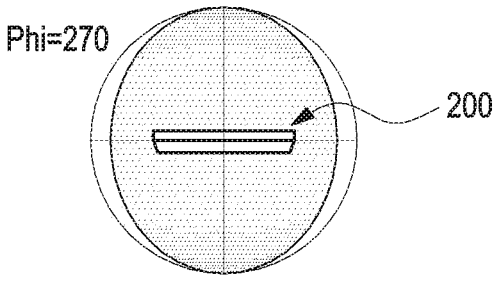

FIGS. 11 and 12 are graphs illustrating measured radiation characteristics of an antenna device without reflective members of an electronic device according to various embodiments of the disclosure.

Figure 13:
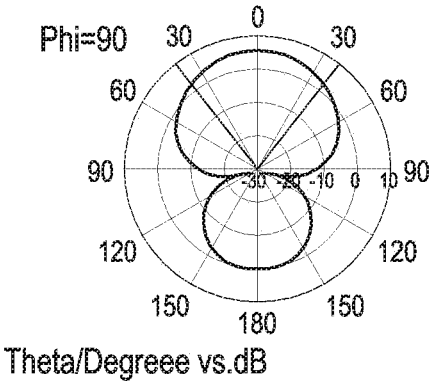
FIGS. 13 and 14 are graphs illustrating measured radiation characteristics of an antenna device with reflective members of an electronic device according to the various embodiments of the disclosure.
Figure 14:
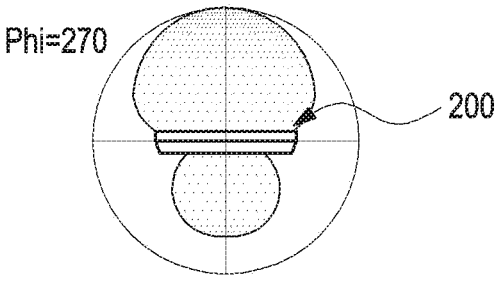

FIGS. 13 and 14 are graphs illustrating measured radiation characteristics of an antenna device with reflective members of an electronic device according to various embodiments of the disclosure.

Referring to FIGS. 11 and 12, the main lobe magnitude in the frequency band of 1.85 GHz was measured to be 3.3 dB before reflective members 206 were disposed, and it can be seen that the radiation power of the antenna device (e.g., the radiation conductors 203) is generally uniformly distributed on the upper side of the electronic device 200 (e.g., the direction in which the first face F1 is oriented) and on the lower side of the electronic device 200 (e.g., the direction in which the second face F2 is oriented).

Referring to FIGS. 13 and 14, after the reflective members 206 were disposed, the main lobe gain in the frequency band of 1.85 GHz was measured to be 6.1 dB, and it can be seen that the radiation power of the antenna device (e.g., the radiation conductors 203) is more concentrated on the upper side of the electronic device 200 than on the lower side of the electronic device 200. For example, it can be seen that it is possible to control the distribution of the radiation power of the antenna device, for example, the orientation, and the like by disposing the reflective members 206. According to an embodiment, when the electronic device 200 is used in the state in which the electronic device 200 is worn on the user's body, the reflective members 206 may suppress the radiation power distribution on the user's body side and may concentrate the radiation power toward an external space, so that the efficiency of the antenna device can be improved or the specific absorption rate (SAR) can be improved.

Figure 15:
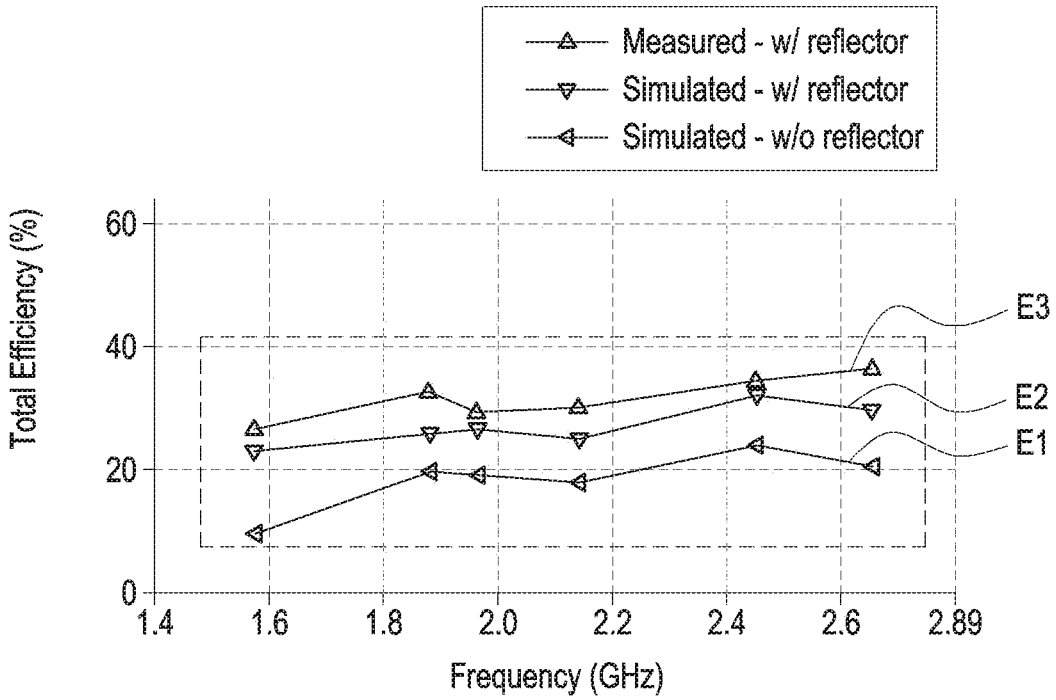
FIG. 15 is a graph showing efficiency of an antenna device measured before and after arranging a reflective member in an electronic device according to an embodiment of the disclosure.

FIG. 15 is a graph showing efficiency of an antenna device measured before and after arranging a reflective member in an electronic device according to an embodiment of the disclosure.

Referring to FIG. 15, a graph shows a result of measuring (or simulating) the efficiency of the antenna device in the state in which the electronic device 200 is worn on the user's body, in which "E1" shows a result of simulating the efficiency of the antenna device in the state in which the reflective member is not disposed, "E2" shows a result of simulating the efficiency of the antenna device in the state in which a reflective member is disposed, and "E3" shows a result of actually measuring the efficiency of the antenna device in the state in which a reflective member is disposed.

Transmission/reception of wireless signals may be somewhat limited in some directions in an actual use environment (e.g., in the state of being worn on a user's body) of the electronic device 200. For example, in the state of being worn on the user's body, the antenna device may have better energy efficiency by distributing the radiation power in a direction toward the outer space rather than toward the user's body. Referring to FIGS. 12 and 14 again, in a free space, the electronic device 200 is able to form radiation power in both the upward direction and the downward direction, and it has been measured that the electronic device 200 has total efficiency of about 80% or more regardless of whether the reflective member 206 is disposed or not in the measured entire frequency band. According to the measurement results shown in FIG. 15, the radiation efficiency of the electronic device 200 may be lowered to about 10 to 40% in an actual use environment such as being worn on the user's body. This is because, in the state in which the lower face of the electronic device 200 is in contact with the user's body, the radiation power in the downward direction is absorbed and attenuated by the user's body.

Referring to FIG. 15, upon comparing the simulation results of the radiation efficiencies E1 and E2 before and after the reflective member 206 is disposed in consideration of an actual use environment (e.g., in the state of being worn on a user's body), it can be seen that the efficiency improvement of approximately 5% or more in the entire measurement frequency band is obtained by disposing the reflective member 206. In addition, it can be seen that the reflective member 206 is able to improve the energy efficiency by 10% or more in a frequency band of 1.6 GHz or less (e.g., GPS communication utilizing 1.575 GHz band). For example, by arranging the reflective member, the energy efficiency of wireless communication performed in a low frequency band is able to be improved even in an actual use environment. It can be seen that the radiation efficiency E3 measured in the actual use environment after the reflective member 206 is disposed is more improved than the simulation result.

As described above, in an electronic device (e.g., the electronic device 200 of FIG. 2) according to various embodiments, a resonant frequency may be easily secured in a low frequency band (e.g., GPS communication frequency band) using the second radiation conductors (e.g., the second radiation conductors 233 of FIG. 4) arranged inside the first radiation conductor 231 (e.g., the first radiation conductor 231 of FIG. 4) utilizing the side wall of the housing in forming an antenna device in a compact space. In an embodiment, a resonant frequency can be secured in another band depending on the configuration of the impedance matching circuit of a feed structure (e.g., the dummy conductor 239 or the lumped elements 253*a* and 253*b* in FIG. 4). In other embodiments, depending on the actual use environment, when the electronic device further includes a reflective member (e.g., the reflective member 206 of FIG. 8), it is possible to control the orientation of the antenna device or to improve radiation efficiency.

Figure 16:
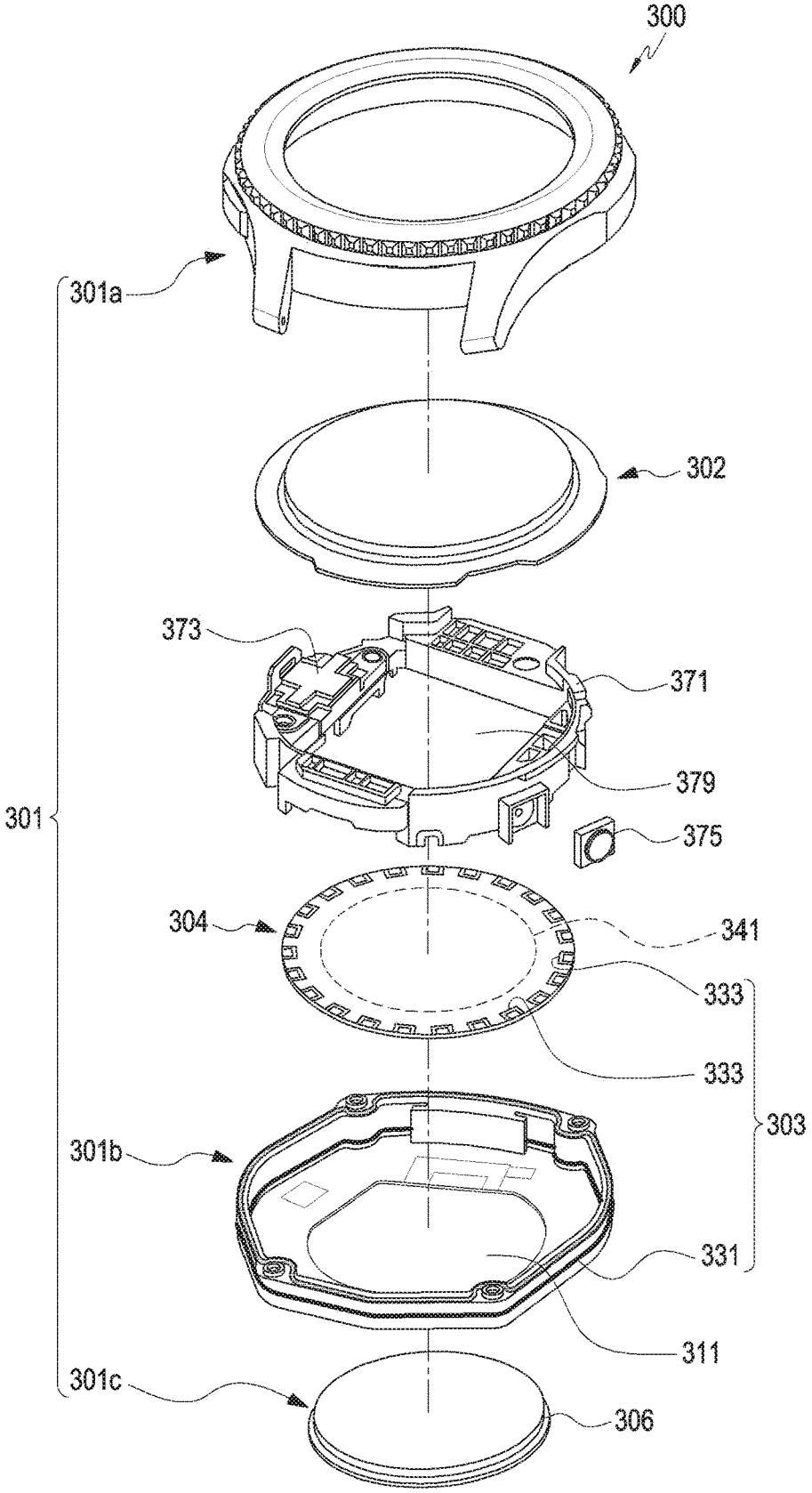
FIG. 16 is an exploded perspective view illustrating an electronic device according to an embodiment of the disclosure.

FIG. 16 is an exploded perspective view illustrating an electronic device according to an embodiment of the disclosure.

Figure 17:
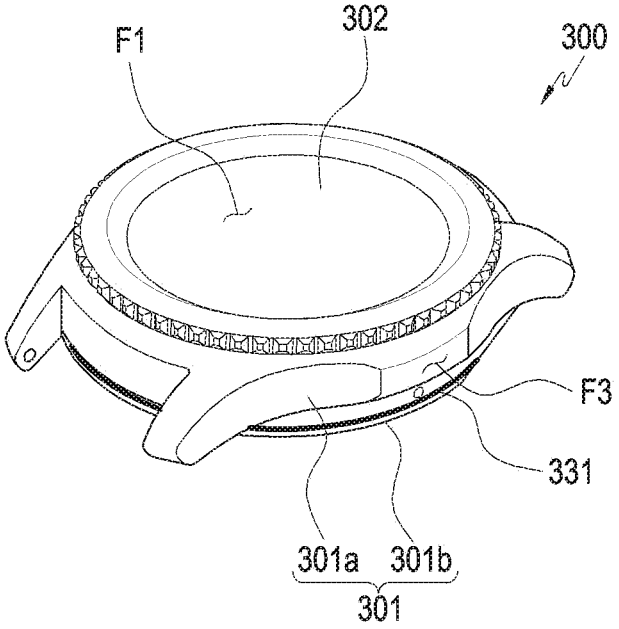
FIG. 17 is a perspective view illustrating the electronic device of FIG. 16 according to an embodiment of the disclosure.

FIG. 17 is a perspective view illustrating the electronic device of FIG. 16 according to an embodiment of the disclosure.

Figure 18:
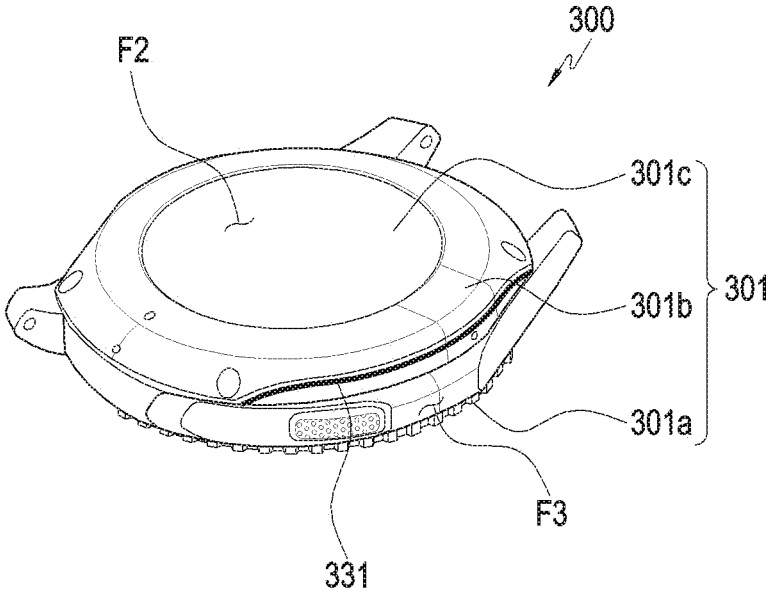
FIG. 18 is a perspective view illustrating the electronic device of FIG. 16 viewed from another direction according to an embodiment of the disclosure.

FIG. 18 is a perspective view illustrating the electronic device of FIG. 16 viewed from another direction according to an embodiment of the disclosure.

Referring to FIGS. 16, 17, and 18, an electronic device 300 (e.g., the electronic device 200 of FIG. 2) is a wearable device that can be worn, for example, on a user's body (e.g., a wrist), and may include a housing 301, a display device 302, a radiation conductor 303, a circuit board 304, and the like. In some embodiments, the electronic device 300 may further include a wearing member (not illustrated) (e.g., a chain or a leather band), and the user may wear the electronic device 300 using such a wearing member.

According to various embodiments of the disclosure, the housing 301 may include a first housing member 301*a*, a second housing member 301*b*, and a cover member 301*c*. The first housing member 301*a* may be disposed on a first face F1 (e.g., the first face F1 in FIG. 2) side, and the display device 302 may be fixedly mounted on the first housing member 301*a*. In some embodiments, the display device 302 may include a window member and a display panel which are integrated with each other, and the display device 302 may be fixed to the first housing member 301*a* so as to form the first face F1 with the first housing member 301*a*. The second housing member 301*b* is disposed on, for example, a second face (e.g., the second face F2 in FIG. 3) side, and may be coupled to face the first housing member 301*a*. According to an embodiment, in the state in which the first housing member 301*a* and the second housing member 301*b* are coupled to each other, the first housing member 301*a* and the second housing member 301*b* may be partially combined with each other so as to form a side wall F3 (e.g., the side wall F3 in FIG. 2 or 3). The cover member 301*c* can be coupled to the outer face of the second housing member 301*b*, for example. In some embodiments, the second housing member 301*b* may include an opening 311 that partially opens the inner space for assembly or performance testing of the electronic device 300. The cover member 301*c* may be coupled to close the opening 311 or the like. For example, the cover member 301*c* may form the second face F2 with the second housing member 301*b*.

According to various embodiments of the disclosure, the housing 301 may accommodate therein a support member 371 that provides means for mounting and fixing the circuit board 304 or various electronic components (e.g., a speaker module 373, and a microphone module 375). The circuit board 304 is mounted with integrated circuit chips or electronic components necessary for the overall operation of the electronic device 300 such as the processor 120 and the communication module 190 of FIG. 1, and may be fixed by the support member 371 in the state of being accommodated in the second housing member 301*b*. The support member 371 may provide a shielding function for preventing electromagnetic interference between various electronic components in the housing 301, may provide a space 379 for accommodating and mounting a battery (e.g., the battery 189 of FIG. 1), or may improve the rigidity of the electronic device 300.

According to various embodiments of the disclosure, radiation conductors 303 (e.g., the radiation conductors 203 of FIG. 4) may include a first radiation conductor 331 provided as a portion of the second housing member 301*b* or the side wall F3 or buried in the second housing member 301*b*, and second radiation conductors 333 arranged on the circuit board 304. In some embodiments, the first radiation conductor 331 may form a generally circular closed loop, and the actual shape of the first radiation conductor 331 may vary according to the shape of the second housing member 301*b*. When the circuit board 304 is accommodated and fixed in the second housing member 301*b*, each of the second radiation conductors 333 is electrically connected to the first radiation conductor 331, and may form a closed loop by being combined with a portion of the first radiation conductor 331. According to an embodiment, the circuit board 304 may include a ground conductor 341 providing a reference potential for the first radiation conductor 331 or the second radiation conductor 333, and the processor or the communication module mounted on the circuit board 304 may perform wireless communication via at least some of the radiation conductors 303 (e.g., the first radiation conductor 331 and one or more second radiation conductors 333).

According to various embodiments of the disclosure, the electronic device 300 may further include a reflective member 306 (e.g., the reflective member 206 of FIG. 8). The reflective member 306 is disposed on the inner face of the cover member 301*c* and may be located between the radiation conductor 303 and the user's body when the user wears the electronic device 300. According to an embodiment, the reflective member 306 may include the second reflective members 263*a* and 263*b* of FIG. 9 or FIG. 10.

Figure 19:
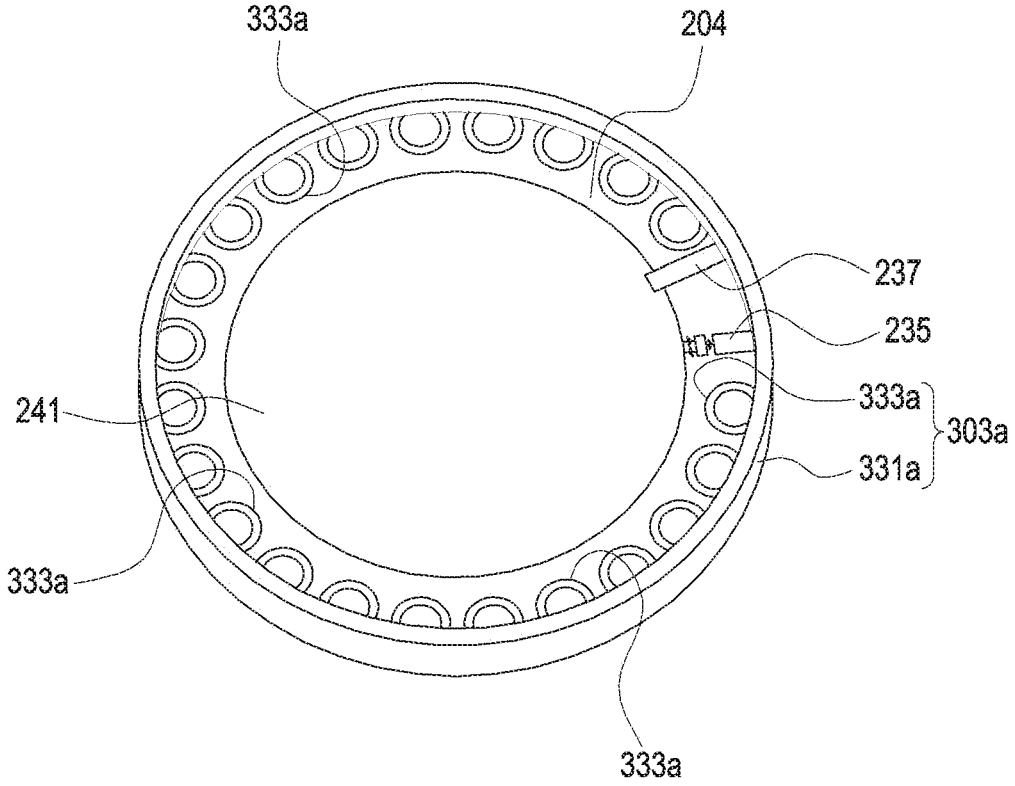
FIG. 19 is a perspective view illustrating a structure of an antenna device of an electronic device according to an embodiment of the disclosure.

FIG. 19 is a perspective view illustrating a structure of an antenna device of an electronic device according to an embodiment of the disclosure.

Figure 20:
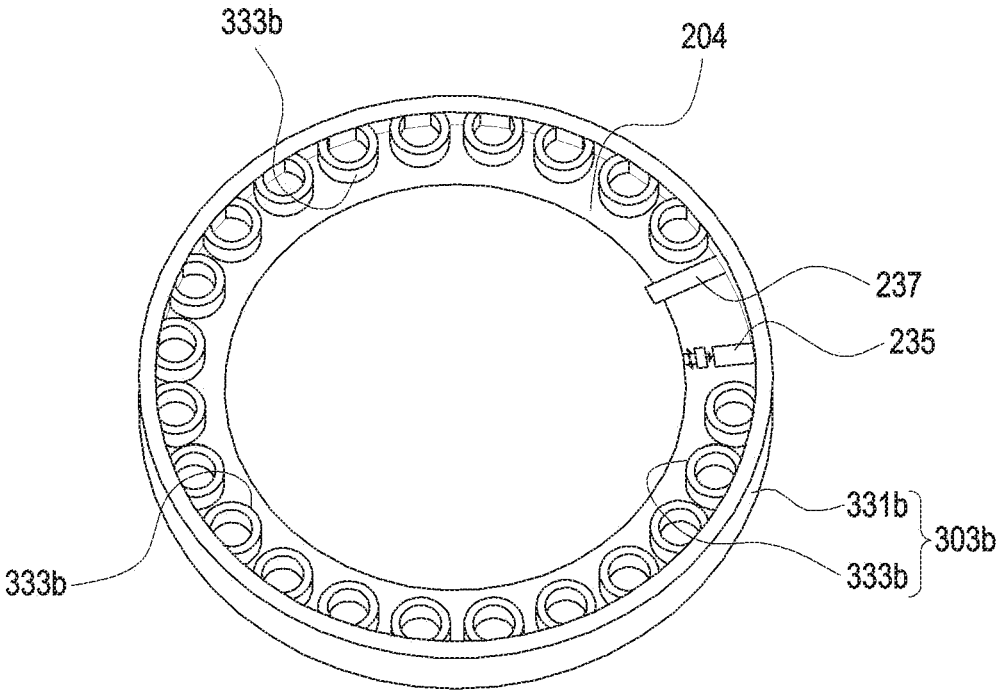
FIG. 20 is a perspective view illustrating a modified example of an antenna device of an electronic device according to an embodiment of the disclosure.

FIG. 20 is a perspective view illustrating a modified example of an antenna device of an electronic device according to an embodiment of the disclosure.

Figure 21:
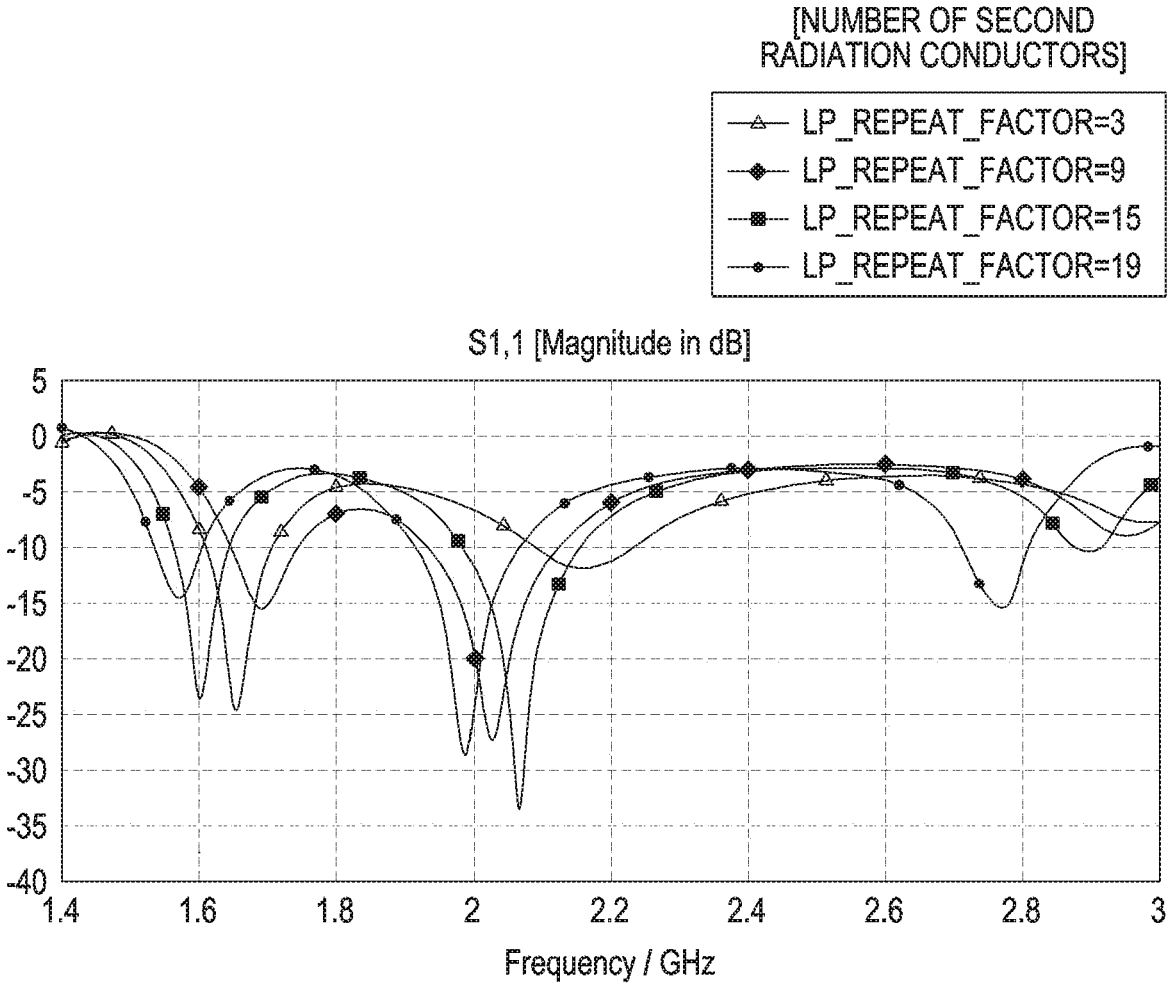
FIG. 21 is a graph showing a reflection coefficient of an antenna device in an electronic device according to an embodiment of the disclosure.

FIG. 21 is a graph showing a reflection coefficient of an antenna device in an electronic device according to an embodiment of the disclosure.

Referring to FIGS. 19 and 20, the radiation conductors 303*a* and 303*b*, which form at least a portion of an antenna device in an electronic device (e.g., the electronic device 200 of FIG. 2) according to various embodiments, may include first radiation conductors 331*a* and 331*b*, and second radiation conductors 333*a* and 333*b*. According to various embodiments of the disclosure, the second radiation conductors 333*a* and 333*b* may have, for example, a generally circular shape and may be combined with some of the first radiation conductors 331*a* and 331*b* so as to form a closed loop.

Referring to FIG. 19, the second radiation conductors 333*a* may be disposed on the circuit board 204. For example, the second radiation conductors 333*a* may be formed as a printed circuit pattern formed on the circuit board 204, and when the circuit board 204 is accommodated in a housing (e.g., the housing 201 of FIG. 2), the second radiation conductors 333*a* may be respectively connected to the first radiation conductors 331*a* so as to form a closed loop.

Referring to FIG. 20, the second radiation conductors 333*b* may be formed integrally with the first radiation conductors 331*b*. For example, the second radiation conductors 333*b* may be made of a material, which is the same as that of the first radiation conductors 331*b*, through a method such as die casting, computer numerical control processing, or the like. Alternatively, the second radiation conductors 333*b* may form a single body and each of the second radiation conductors 333*b* may be combined with some of the first radiation conductors 331*b* so as to form a closed loop. In some embodiments, when the second radiation conductors 333*b* are formed integrally with the first radiation conductors 331*b*, the second radiation conductors 333*b* may provide means for fixing the circuit board 204 in the housing.

According to various embodiments of the disclosure, the radiation conductors 303*a* and 303*b* may include a feed port 235 and a shorting pin 237, and may be provided with a reference potential via a ground conductor 241 provided on the circuit board 204 or the like. The connection structure of the feed port 235, the shorting pin 237, and the ground conductor 241, or the like may be easily understood with reference to FIG. 4 and may be variously modified depending on the manufacturing of an actual product.

Referring to FIG. 21, a graph shows a change in the reflection coefficient, for example, an S11-parameter, depending on the number of the second radiation conductors 333*a*, 333*b*, for example. The graph shows results obtained by measuring the reflection coefficient S11 in the structures in which the radiation conductors 303*a* and 303*b* include 3, 9, 15, and 19 second radiation conductors 333*a* and 333*b*. Referring to FIG. 21, the resonant frequency formed in each of a plurality of resonant frequency bands gradually decreases as the number of the second radiation conductors 333*a* and 333*b* increases. For example, the electronic device according to various embodiments is able to secure a resonant frequency in a low frequency band by including the second radiation conductors 333*a* and 333*b* even if the installation space of the antenna device is compact.

Figure 22:
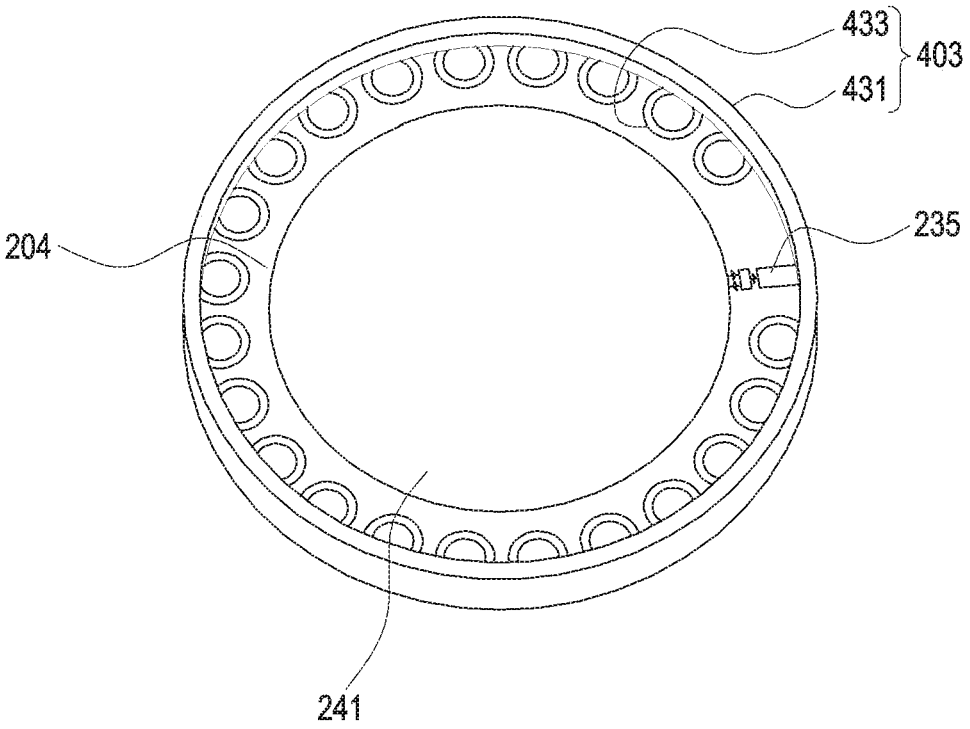
FIG. 22 is a perspective view illustrating a structure of an antenna device of an electronic device according to an embodiment of the disclosure.

FIG. 22 is a perspective view illustrating a structure of an antenna device of an electronic device according to an embodiment of the disclosure.

Figure 23:
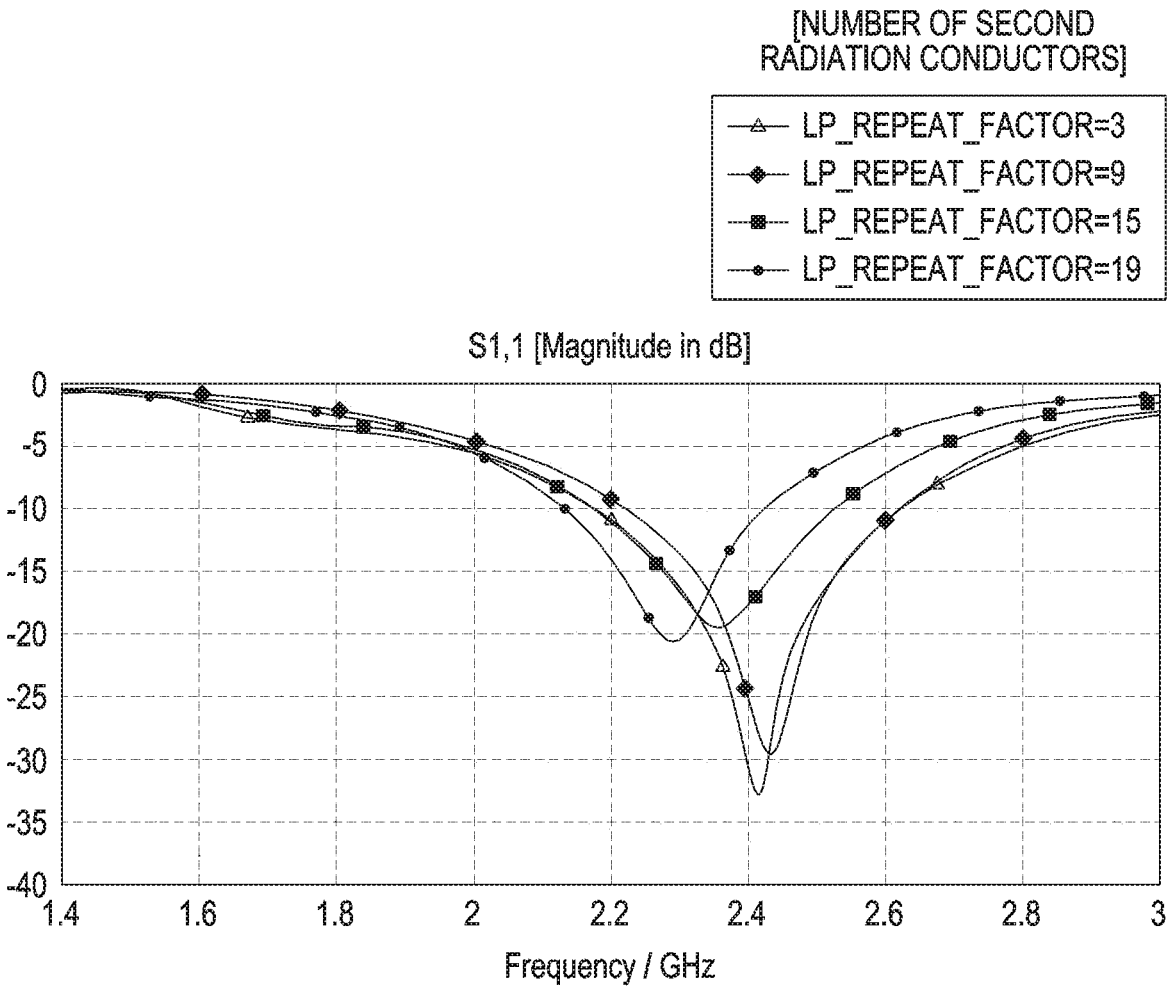
FIG. 23 is a graph showing a reflection coefficient of an antenna device in an electronic device according to an embodiment of the disclosure.

FIG. 23 is a graph showing a reflection coefficient of an antenna device in an electronic device according to an embodiment of the disclosure.

Referring to FIG. 22, radiation conductors 403 forming at least a portion of an antenna device in an electronic device (e.g., the electronic device 200 of FIG. 2) may include a first radiation conductor 431 and second radiation conductors 433 and may be provided with a reference potential via a ground conductor 241 provided on the circuit board 204. According to various embodiments, the second radiation conductors 433 may have, for example, a generally circular shape and may form a closed loop in combination with a portion of the first radiation conductor 431. In an embodiment, the second radiation conductors 433 may be provided on the circuit board 204. According to various embodiments, the radiation conductors 403 may form a mono-pole antenna structure in a structure in which the radiation conductors 403 include a feed port 235, but does not include a shorting pin (e.g., the shorting pin 237 in FIG. 19).

Referring to FIG. 23, a graph shows a change in reflection coefficient, for example, S11-parameter, depending on the number of the second radiation conductors 433, for example. The graph shows results obtained by measuring the reflection coefficient S11 in the structure in which the radiation conductors 403 include 3, 9, 15, and 21 second radiation conductors 433. Referring to FIG. 23, the resonant frequency formed by the radiation conductors 403 gradually decreases as the number of the second radiation conductors 433 increases. For example, the electronic device according to various embodiments is able to secure a resonant frequency in a low frequency band by including the second radiation conductors 433 even if the installation space of the antenna device is narrow.

Figure 24:
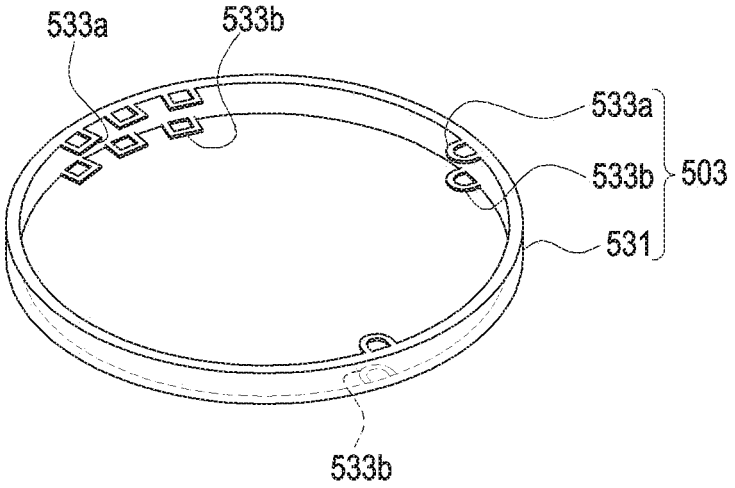
FIGS. 24 and 25 are views for explaining modified examples of an antenna device of an electronic device according to various embodiments of the disclosure.
Figure 25:
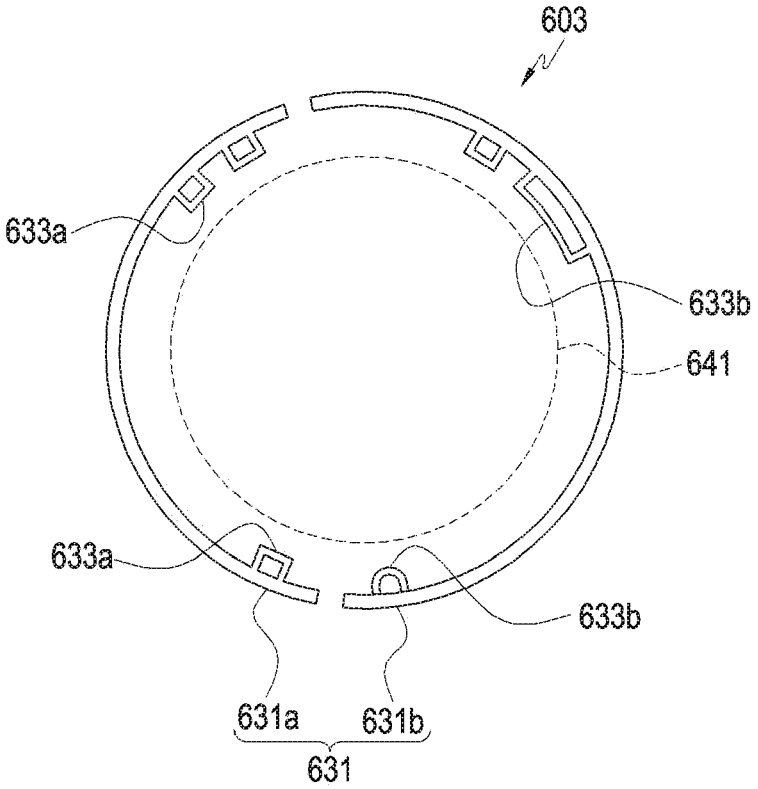

FIGS. 24 and 25 are views for explaining modified examples of an antenna device of an electronic device according to various embodiments of the disclosure.

Referring to FIGS. 24 and 25, various embodiments of radiation conductors (e.g., the radiation conductors 203 in FIG. 4) are illustrated. The configuration of a circuit board (e.g., the circuit board 204 in FIG. 4) will be described below with reference to the preceding embodiments.

Referring to FIG. 24, an electronic device according to various embodiments may include radiation conductors 503 provided as an antenna, for example, a first radiation conductor 531 and conductive patterns 533*a*, and 533*b* electrically connected to the first radiation conductor 531. According to an embodiment, the first radiation conductor 531 has a predetermined thickness (or height) and may have a loop structure. The conductive patterns may include, for example, first conductive patterns 533*a* arranged on the inner circumferential face of the first radiation conductor 531 on the upper side of the first radiation conductor 531, and second conductive patterns 533*b* arranged along the inner circumferential face of the first radiation conductor 531 on the lower side of the first radiation conductor 531. It is noted that in this embodiment, the first conductive patterns 533*a* and the second conductive patterns 533*b* have generally similar sizes and shapes, but the disclosure is not limited thereto. For example, the positions, numbers, shapes, and sizes of the first conductive patterns 533*a* and the second conductive patterns 533*b* may vary depending on the frequency band to be used and the actual use environment.

According to various embodiments of the disclosure, the first conductive patterns 533*a* may be formed on a first face of the above-described circuit board (e.g., the circuit board 204 of FIG. 4), and the second conductive patterns 533*b* may be formed on the second face of the circuit board 204. When the circuit board 204 is assembled with the radiation conductors 503, the first conductive patterns 533*a* and the second conductive patterns 533*b* may be electrically connected to the first radiation conductor 531. For example, the first conductive patterns 533*a* and the second conductive patterns 533*b* may form an electrically closed loop with the first radiation conductor 531, respectively.

As described in the above-described embodiments, a first radiation conductor (e.g., the first radiation conductor 231 of FIG. 4) may be formed by arranging a plurality of conductors to form a loop structure.

Referring to FIG. 25, the radiation conductor 631 may include two first radiation conductors 631*a* and 631*b* having an arc shape and may be arranged so as to form a substantially circular loop shape in a state of being spaced apart from each other. Hereinafter, for the sake of concise description, a first radiation conductor indicated by reference numeral 631*a* will be referred to as a "first radiation portion," and a first radiation conductor indicated by reference numeral 631*b* will be referred to as a "second radiation portion."

According to various embodiments of the disclosure, the radiation conductors 603 may include first conductive patterns 633*a* electrically connected to the first radiation portion 631*a*. The first conductive patterns 633*a* may be disposed generally inside the first radiation portion 631*a* and may be arranged along the inner circumferential face of the first radiation portion 631*a*. Although the first radiation portion 631*a* and the first conductive patterns 633*a* are separately described, according to an embodiment, the first conductive patterns 633*a* may be practically formed as a portion of the first radiation portion 631*a*. In another embodiment, the first conductive patterns 633*a* are formed on a circuit board (e.g., the circuit board 204 of FIG. 4), and when the first radiation portion 631*a* is assembled to the circuit board, the first conductive patterns 633*a* may be electrically connected to the first radiation portion 631*a*.

According to various embodiments of the disclosure, the radiation conductors 603 may include second conductive patterns 633*b* electrically connected to the second radiation portion 631*b*. The second conductive patterns 633*b* may be disposed generally inside the second radiation portion 631*b* and may be arranged along the inner circumferential face of the second radiation portion 631*b*. Although the second radiation portion 631*b* and the second conductive patterns 633*b* are separately described, according to an embodiment, the second conductive patterns 633*b* may be practically formed as a portion of the second radiation portion 631*b*. In another embodiment, the second conductive patterns 633*b* are formed on a circuit board (e.g., the circuit board 204 of FIG. 4), and when the second radiation portion 631*b* is assembled to the circuit board, the second conductive patterns 633*b* may be electrically connected to the second radiation portion 631*b*. In another embodiment, the second conductive patterns 633*b* may be arranged around a ground conductor 641 formed in the circuit board.

As described above, according to various embodiments of the disclosure, an electronic device may include a housing including a first face, a second face that faces a direction opposite to the first face, and a side wall that encloses at least a portion of a space between the first face and the second face, a first radiation conductor formed or extended along a circumferential direction of the housing as a portion of the side wall, and a plurality of second radiation conductors electrically connected to the first radiation conductor, and arranged inside the first radiation conductor in a direction where the first radiation conductor extends.

The plurality of second radiation conductors may form a plurality of closed loops with the first radiation conductor.

According to various embodiments of the disclosure, the electronic device may further include: a processor or a communication module accommodated in the housing, and the processor or the communication module may be set to perform wireless communication via at least one of the first radiation conductor and the second radiation conductors.

According to various embodiments of the disclosure, the first radiation conductor may be formed in a closed loop shape.

According to various embodiments of the disclosure, the plurality of closed loops may be formed in any one of circular, elliptical, and polygonal shapes.

According to various embodiments of the disclosure, the plurality of second radiation conductors may formed as at least a portion of the first radiation conductor, and may extend from the first radiation conductor into the inside of the housing.

According to various embodiments of the disclosure, the electronic device may further include a first reflective member disposed between the second face and the first radiation conductor, and the first radiation conductor or the second radiation conductors transmits/receives a wireless signal, and the first reflective member may reflect the wireless signal in a direction where the first face is oriented.

According to various embodiments of the disclosure, the electronic device may further include at least one second reflective member disposed on the first reflective member, and the at least one second reflective member may be formed as at least a portion of the first reflective member and may form a closed loop with the first reflective member.

According to various embodiments of the disclosure, the electronic device may further include a circuit board accommodated in the housing, and the plurality of second radiation conductors may be arranged along an edge of the circuit board.

According to various embodiments of the disclosure, the electronic device may further include: a ground conductor provided on the circuit board; and a feed port extending from any one of the first radiation conductor and the second radiation conductors and configured to receive a feed signal.

According to various embodiments of the disclosure, the electronic device may further include: a dummy conductor disposed between the ground conductor and the feed port; a feed point disposed between the ground conductor and the dummy conductor; and lumped elements connecting the dummy conductor to each of the ground conductor and the feed port.

According to various embodiments of the disclosure, the electronic device may further include: a ground conductor provided on the circuit board; a shorting pin extending from any one of the first radiation conductor and the second radiation conductors and connected to the ground conductor; and a feed port extending from any one of the first radiation conductor and the second radiation conductors and configured to receive a feed signal.

According to various embodiments of the disclosure, the housing may include a first housing member disposed on a first face side, and a second housing member disposed on the second face side and coupled to face the first housing member.

At least a portion of the first housing member and at least a portion of the second housing member may form the sidewall.

According to various embodiments of the disclosure, the first radiation conductor may be disposed in the second housing member.

According to various embodiments of the disclosure, an electronic device may include: an antenna; a circuit board including a first conductive pattern and a second conductive pattern, which are electrically connected to the antenna to form a closed loop; and a communication circuit configured to transmit/receive a signal with an external electronic device using the antenna to which the first conductive pattern and the second conductive pattern are electrically connected.

According to various embodiments of the disclosure, the circuit board may include a ground conductor, and the antenna may further include a portion connected to the ground conductor.

According to various embodiments of the disclosure, the electronic device may further include a reflective member disposed in a first direction of the circuit board, and the reflective member may improve transmission or reception performance in a second direction opposite to the first direction.

According to various embodiments of the disclosure, the reflective member may include a plurality of third conductive patterns, and the third conductive patterns may form a plurality of closed loops.

An electronic device according to various embodiments of the disclosure is a wearable device that is capable of being worn on a body. The wearable device may include: an antenna including a feed portion and a radiation portion, and further including a first conductive pattern and a second conductive pattern that form a closed loop with at least a portion of the radiation portion; and a communication circuit electrically connected to the feeding unit and configured to transmit/receive a signal to/from an external electronic device using the antenna including the first conductive pattern and the second conductive pattern.

According to various embodiments of the disclosure, the first conductive pattern may be formed in a first shape, and the second conductive pattern may be formed in a second shape.

According to various embodiments of the disclosure, the radiation portion may include a first radiation portion and a second radiation portion spaced from the first radiation portion, the first conductive pattern may be formed in the first radiation portion; and the second conductive pattern may be formed in the second radiation portion.

In the foregoing detailed description, specific embodiments of the disclosure have been described. However, it will be evident to a person ordinarily skilled in the art that various modification may be made without departing from the scope of the disclosure. For example, in a specific embodiment of the disclosure, a structure in which a second radiation conductor (e.g., the second radiation conductor 233 of FIG. 4) and a first radiation conductor (e.g., the first radiation conductor 231 of FIG. 4) are combined with each other to form a closed loop. However, the second radiation conductor itself may form a closed loop, and a portion of the second radiation conductor may be connected to the first radiation conductor so as to form various current flow paths.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a housing including a first face, a second face that faces a direction opposite to the first face, and a side wall that encloses a portion of a space between the first face and the second face;

a circuit board disposed in the housing and provided with a ground conductor;

a first radiation conductor extended along a circumferential direction of the side wall;

a first reflective member disposed between the second face and the first radiation conductor, the first reflective member having a shape substantially corresponding to the first radiation conductor; and a plurality of second radiation conductors electrically connected to the first radiation conductor, and arranged inside of the first radiation conductor in a direction where the first radiation conductor extends, wherein the plurality of second radiation conductors form a plurality of closed loops with the first radiation conductor, and wherein the first reflective member is configured to reflect a wireless signal in a direction where the first face is oriented.

2. The electronic device of claim 1, further comprising:

at least one processor disposed in the housing and configured to perform wireless communication via at least one of the first radiation conductor or the plurality of second radiation conductors.

3. The electronic device of claim 1, wherein the plurality of closed loops are formed as one of circular, elliptical, or polygonal shapes.

4. The electronic device of claim 1, wherein the plurality of second radiation conductors are formed as a portion of the first radiation conductor, and extend from the first radiation conductor inwardly into the housing.

5. The electronic device of claim 1, wherein the first radiation conductor or the plurality of second radiation conductors are configured to transmit and receive the wireless signal.

6. The electronic device of claim 5, further comprising:

at least one second reflective member disposed on the first reflective member, wherein the at least one second reflective member is formed as a portion of the first reflective member and forms a closed loop with the first reflective member.

7. The electronic device of claim 1, wherein the plurality of second radiation conductors are arranged along an edge of the circuit board.

8. The electronic device of claim 7, further comprising:

a feed port extending from one of the first radiation conductor or the plurality of second radiation conductors and configured to receive a feed signal.

9. The electronic device of claim 8, further comprising:

a dummy conductor disposed between the ground conductor and the feed port;

a feed point disposed between the ground conductor and the dummy conductor; and lumped elements connecting the dummy conductor to the ground conductor and the feed port.

10. The electronic device of claim 7, further comprising:

a shorting pin extending from one of the first radiation conductor or the plurality of second radiation conductors and connected to the ground conductor; and a feed port extending from one of the first radiation conductor or the plurality of second radiation conductors and configured to receive a feed signal.

11. The electronic device of claim 1, wherein the reflective member is configured to control an orientation of the first radiation conductor and the plurality of second radiation conductors while the electronic device is in a state of being worn on a user's body.

12. An electronic device comprising:

a housing including a first face, a second face that faces a direction opposite to the first face, and a side wall that encloses a portion of a space between the first face and the second face;

a first radiation conductor extended along a circumferential direction of the side wall; and a plurality of second radiation conductors electrically connected to the first radiation conductor, and arranged inside of the first radiation conductor in a direction where the first radiation conductor extends, wherein the plurality of second radiation conductors form a plurality of closed loops with the first radiation conductor, wherein the housing further includes a first housing member disposed on a first face side, and a second housing member disposed on a second face side and configured to face the first housing member, and wherein a portion of the first housing member and a portion of the second housing member form the side wall.

13. The electronic device of claim 12, wherein the first radiation conductor is disposed in the second housing member.

14. An electronic device comprising:

an antenna;

a circuit board including a ground conductor, a first conductive pattern, and a second conductive pattern being electrically connected to the antenna forming a closed loop;

a reflective member disposed in a first direction of the circuit board, the reflective member having a shape substantially corresponding to the first conductive pattern; and a communication circuit configured to transmit and receive a signal with an external electronic device using the antenna, wherein the reflective member improves transmission or reception performance in a second direction opposite to the first direction.

15. The electronic device of claim 14, wherein the antenna further includes a portion connected to the ground conductor.

16. The electronic device of claim 14, wherein the reflective member includes a plurality of third conductive patterns configured to form a plurality of closed loops.

17. A wearable device comprising:

a circuit board;

an antenna including a feed portion, a radiation portion, first conductive patterns, and second conductive patterns, the feed portion extending from the radiation portion and being configured to supply a feed signal to the radiation portion, the first conductive patterns and the second conductive patterns forming a closed loop with a portion of the radiation portion; and a communication circuit electrically connected to the feed portion and configured to communicate a signal with an external electronic device using the antenna, wherein the second conductive patterns are formed on the circuit board, and wherein the first conductive patterns are arranged along an extending direction which the radiation portion extends and the second conductive patterns are arranged along the extending direction.

18. The wearable device of claim 17, wherein the first conductive pattern is formed as a first shape, and wherein the second conductive pattern is formed as a second shape.

19. The wearable device of claim 17, wherein the radiation portion includes a first radiation portion and a second radiation portion spaced from the first radiation portion, wherein the first conductive pattern is formed in the first radiation portion, and wherein the second conductive pattern is formed in the second radiation portion.

20. The wearable device of claim 17, wherein the first conductive patterns are formed on the circuit board.

21. An electronic device comprising:

a housing including a first face, a second face that faces a direction opposite to the first face, and a side wall that encloses a portion of a space between the first face and the second face;

a first radiation conductor extended along a circumferential direction of the side wall; and a plurality of second radiation conductors electrically connected to the first radiation conductor, and arranged inside of the first radiation conductor in a direction where the first radiation conductor extends, wherein the plurality of second radiation conductors form a plurality of closed loops with the first radiation conductor, and wherein the first radiation conductor is formed as a closed loop shape.

* * * * *